US011229574B2

(12) United States Patent
Haddock et al.

(10) Patent No.: US 11,229,574 B2
(45) Date of Patent: Jan. 25, 2022

(54) MASSAGER DEVICE WITH EXPANSION FUNCTION

(71) Applicant: Uccellini LLC, Bend, OR (US)

(72) Inventors: Lora LeeAnne Haddock, Bend, OR (US); Lola Vars, Corvallis, OR (US); Ada-Rhodes Short, Corvallis, OR (US); Avery Smith, Albany, OR (US); Kim Porter Henneman, Bend, OR (US); Douglas S. Layman, Bend, OR (US); Blake Michael Larkin, Eugene, OR (US); Brian Scott Gaza, Naperville, IL (US); Mark Hazelton, Philomath, OR (US); Mazie Houchens, Corvallis, OR (US)

(73) Assignee: UCCELLINI LLC, Bend, OR (US)

( * ) Notice: Subject to any disclaimer, the term of this patent is extended or adjusted under 35 U.S.C. 154(b) by 195 days.

(21) Appl. No.: 16/569,727

(22) Filed: Sep. 13, 2019

(65) Prior Publication Data

US 2020/0085681 A1 Mar. 19, 2020

Related U.S. Application Data

(63) Continuation-in-part of application No. 29/695,752, filed on Jun. 21, 2019, now Pat. No. Des. 898,937, (Continued)

(51) Int. Cl.

| | |
|---|---|
| ***A61H 19/00*** | (2006.01) |
| ***A61H 23/02*** | (2006.01) |
| ***A61H 15/00*** | (2006.01) |

(52) U.S. Cl.

CPC ..... *A61H 19/44* (2013.01); *A61H 15/00* (2013.01); *A61H 19/34* (2013.01); *A61H 23/02* (2013.01);

(Continued)

(58) Field of Classification Search

CPC ..... A61H 19/00; A61H 19/32; A61H 19/34; A61H 19/40; A61H 19/44; A61H 15/00

See application file for complete search history.

(56) References Cited

U.S. PATENT DOCUMENTS

| | | | |
|---|---|---|---|
| 1,755,144 | A | 4/1930 | Arranz |
| 2,076,410 | A | 4/1937 | McGerry |

(Continued)

FOREIGN PATENT DOCUMENTS

| | | | |
|---|---|---|---|
| AU | 2018200317 | A1 | 2/2018 |
| CN | 105596194 | | 5/2016 |

(Continued)

OTHER PUBLICATIONS

EP Application No. 19817568.9, Partial Search Report, dated Jul. 17, 2020, 37 pgs.

(Continued)

*Primary Examiner* — John P Lacyk

(74) *Attorney, Agent, or Firm* — Keohane & D'Alessandro, PLLC

(57) ABSTRACT

Disclosed embodiments provide a massager having at least one expandable chamber. In some embodiments, there is provided an expandable shaft chamber that is inflatable to push a stimulator towards the G-spot of the user to increase contact pressure in that area. This inflation can also allow for a hands-free experience by expanding the width of the shaft inside the vagina for a snug fit tight against the vaginal or rectum walls. In some embodiments, there is provided an expandable ring chamber that is inflatable to securely hold a massager device inside the vagina or rectum, allowing for a hands-free experience.

23 Claims, 32 Drawing Sheets

Related U.S. Application Data and a continuation-in-part of application No. 29/675,567, filed on Jan. 3, 2019, now Pat. No. Des. 884,206, said application No. 29/695,752 is a continuation-in-part of application No. 29/675,567, filed on Jan. 3, 2019, now Pat. No. Des. 884,206.

(60) Provisional application No. 62/869,008, filed on Jun. 30, 2019, provisional application No. 62/868,247, filed on Jun. 28, 2019, provisional application No. 62/868,331, filed on Jun. 28, 2019, provisional application No. 62/868,232, filed on Jun. 28, 2019, provisional application No. 62/868,266, filed on Jun. 28, 2019, provisional application No. 62/868,218, filed on Jun. 28, 2019, provisional application No. 62/868,203, filed on Jun. 28, 2019, provisional application No. 62/868,279, filed on Jun. 28, 2019, provisional application No. 62/868,312, filed on Jun. 28, 2019, provisional application No. 62/787,930, filed on Jan. 3, 2019, provisional application No. 62/731,838, filed on Sep. 15, 2018, provisional application No. 62/731,840, filed on Sep. 15, 2018, provisional application No. 62/731,835, filed on Sep. 15, 2018, provisional application No. 62/731,836, filed on Sep. 15, 2018, provisional application No. 62/731,839, filed on Sep. 15, 2018.

(52) U.S. Cl.
CPC ..... *A61H 2201/0103* (2013.01); *A61H 2201/1238* (2013.01); *A61H 2201/5071* (2013.01)

(56) References Cited

U.S. PATENT DOCUMENTS

| | | | |
|---|---|---|---|
| 5,010,895 | A | 4/1991 | Maurer et al. |
| 6,099,463 | A | 8/2000 | Hockhalter |
| 6,733,438 | B1 | 5/2004 | Dann et al. |
| 7,104,950 | B2 | 9/2006 | Levy |
| 7,530,944 | B1 | 5/2009 | Kain |
| 7,534,203 | B2 | 5/2009 | Gil |
| 8,308,631 | B2 | 11/2012 | Kobashikawa et al. |
| 8,579,837 | B1 | 11/2013 | Makower et al. |
| D712,059 | S | 8/2014 | Sedic |
| 9,339,434 | B1 | 5/2016 | Mayfield |
| 9,737,458 | B1 | 8/2017 | Olivares et al. |
| 9,763,851 | B2 | 9/2017 | Lenke |
| 9,849,061 | B2 | 12/2017 | Lenke |
| 9,937,097 | B2 | 4/2018 | Lenke |
| 10,004,659 | B1 | 6/2018 | Campbell |
| D825,073 | S | 8/2018 | Lenke |
| D848,013 | S | 5/2019 | Fuhner et al. |
| 2003/0176817 | A1 | 9/2003 | Chang |
| 2004/0082831 | A1 | 4/2004 | Kobashikawa et al. |
| 2004/0186344 | A1 | 9/2004 | Jannuzzi |
| 2005/0240122 | A1 | 10/2005 | Gander et al. |
| 2005/0256369 | A1 | 11/2005 | Gloth |
| 2005/0273024 | A1 | 12/2005 | Nan |
| 2007/0142754 | A1 | 6/2007 | Nan |
| 2009/0069730 | A1 | 3/2009 | Knyrim |
| 2009/0093673 | A1 | 4/2009 | Lee |
| 2009/0177029 | A1 | 7/2009 | Alilovich |
| 2010/0268021 | A1 | 10/2010 | Standfest et al. |
| 2011/0124959 | A1 | 5/2011 | Murison |
| 2012/0215141 | A1 | 8/2012 | Peddicord |
| 2013/0012769 | A1 | 1/2013 | Carlson |
| 2013/0178769 | A1 | 7/2013 | Schmidt |
| 2014/0228628 | A1 | 8/2014 | De Alva |
| 2014/0309565 | A1 | 10/2014 | Allen |
| 2015/0196455 | A1 | 7/2015 | Mertens et al. |
| 2016/0022532 | A1 | 1/2016 | Makower et al. |
| 2016/0045392 | A1 | 2/2016 | Massey et al. |
| 2016/0213557 | A1 | 7/2016 | Lenke |
| 2017/0027809 | A1 | 2/2017 | Lenke |
| 2017/0065483 | A1 | 3/2017 | Lenke |
| 2017/0100303 | A1 | 4/2017 | Kotlov |
| 2017/0216135 | A1 | 8/2017 | Lenke |
| 2017/0281457 | A1 | 10/2017 | Witt |
| 2018/0092799 | A1 | 4/2018 | Lenke |
| 2018/0140502 | A1 | 5/2018 | Shahoian et al. |
| 2018/0153764 | A1 | 6/2018 | Lenke |
| 2018/0243161 | A1 | 8/2018 | Lenke |
| 2018/0243162 | A1 | 8/2018 | Lenke |

FOREIGN PATENT DOCUMENTS

| | | | |
|---|---|---|---|
| CN | 206198255 | | 5/2017 |
| EP | 3300712 | A1 | 4/2018 |
| JP | 10165465 | | 6/1998 |
| JP | 2007082990 | A | 9/2005 |
| WO | 9802124 | | 1/1998 |
| WO | 2011094799 | A1 | 8/2011 |
| WO | 2013067367 | A1 | 5/2013 |
| WO | 2014085736 | A1 | 6/2014 |
| WO | 2017205860 | A1 | 11/2017 |

OTHER PUBLICATIONS

Young, Lee, International Application No. PCT/US19/50938, PCT Search Report & Written Opinion, dated Nov. 29, 2019, 11 pgs.
Rodriguez, Ariana, "Womanizer Releases New Products, hits Sales Milestone", XBIX.com, Jan. 19, 2018, 13 pgs.
"Irresistible", by Shots, www.ean-online.com/ebooks/EAN_06_2019, 2019, 1 pgs.
"Shots—Irresistible—Mythical—Touchless Clotorial Stimulation", www.youtube.com/watch?v=9hjxKpQBCVU, May 31, 2019, 4 pgs.
"Shots—Irresistible Collection—Promo" https://www.youtube.com/watch?v=ixi_jvwV8g8, Mar. 26, 2019, 1 pg.
EP Application No. 198175697-1126, Supplementary Partial EP Search Report, dated Sep. 22, 2020, 16 pgs.
EP Application No. 19817570.5-1126, Search Report, Sep. 23, 2020, 15 pgs.
Eaton, Kit, "New Sasi Sex Toy Gets Intelligent With Your Nether Regions", Gizmodo, https://gizmodo.com/new-sasi-sex-toy-gets-intelligent-with-your-nether-regi-346406, Jan. 18, 2008, 4 pgs.
Sloan, Kate, "Review: JeJoue Sasi", Girlyjuice, https://girlyjuice.net/review-jejoue-sasi/, Mar. 11, 2013, 2 pgs.
Sutra, Cara, Je Joue Sasi Review (& Lelo Ora Oral Sex Simulator Comparison), Carasutra, https://carasutra.com/review/je-joue-sasi-review-lelo-ora-oral-sex-simulator-comparison/, Feb. 24, 2014, 6 pgs.
Alptraum, Lux, "The Vibrator of the Future Won't Vibrate", Motherboard Tech by Vice, https://www.vice.com/en_us/article/qkjz8x/the-vibrator-of-the-future-wont-vibrate, Jul. 14, 2016, 6 pgs.
"Je Joue SaSi Vibrator, Plum", Amazon, https://camelcamelcamel.com/Je-Joue-SaSi-Vibrator-Plum/product/B002T5LKMQ, 2010, 5 pgs.
"Je Joue Sasi, Tongue Massager", AliExpress, https://www.aliexpress.com/item/552706705.html, 2008, 5 pgs.
"SASI Product", 2008, 5 pgs.

MASSAGER DEVICE WITH EXPANSION FUNCTION

FIELD

Embodiments of the invention relate to sexual aids, and more specifically, to a massager having a shaft that can expand and retract in width/girth.

BACKGROUND

There are various devices available for use by female bodies for sexual stimulation. They are typically configured to stimulate the clitoris and/or the Grafenberg Spot. Such area, also known as the "G-spot," is a nerve reflex area inside the vagina along the anterior surface. In male bodies, the prostate is a gland surrounding the neck of the bladder. Products for G-spot or prostate massage are entirely manually operated, or are provided with internal motors that achieve stimulation by shape, texture and vibration. There exists a need for improvements in devices for stimulation of the clitoris, G-spot and the prostate.

SUMMARY

Disclosed embodiments provide a massager having at least one expandable chamber. Manual operation of a sexual massager can be tiresome as the device needs to be shifted in and out of the vagina or anus by hand, or continual manual pressure must be applied. In some cases, it is pleasurable for the massager to remain inside the vagina or rectum without the user having to hold it with hands. Some embodiments of the invention provide an expandable shaft chamber that is inflatable to push a massage surface towards the G-spot or prostate of the user to increase contact pressure in that area. This inflation can also allow for a hands-free experience (meaning the user can take hands off of the device once positioned without the device falling out of the vagina or rectum) by expanding the width of the shaft inside the vagina for a snug fit tight against the vaginal or rectum walls. Some embodiments provide an expandable ring chamber that is inflatable to securely hold a massager device inside the vagina or rectum, allowing for a hands-free experience.

In some embodiments, there is provided a massager device comprising: an insertable shaft having a first side and a second side, wherein the first side comprises a massage surface; a stimulator; and an expandable shaft chamber disposed on the second side of the insertable shaft.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1A:
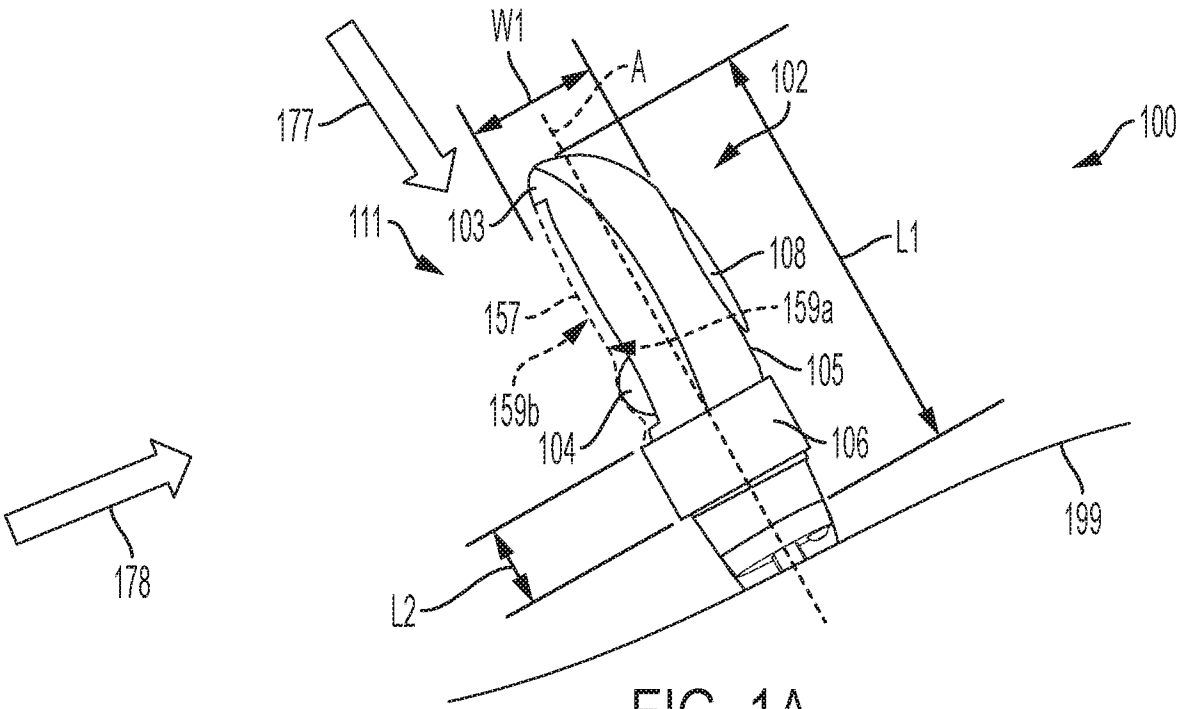
FIG. 1A is a side view of an insertable portion in accordance with some embodiments of the present invention.

The drawings are not necessarily to scale. The drawings are merely representations, not intended to portray specific parameters of the invention. The drawings are intended to depict only typical embodiments of the invention, and therefore should not be considered as limiting in scope. In the drawings, like numbering represents like elements. Furthermore, certain elements in some of the figures may be omitted, or illustrated not-to-scale, for illustrative clarity.

DETAILED DESCRIPTION

Disclosed embodiments provide a massager having at least one expandable chamber. Manual operation of a sexual massager can be tiresome as the device needs to be shifted in and out of the vagina or anus by hand, or continual manual pressure must be applied. In some cases, it is pleasurable for the massager to remain inside the vagina or rectum without the user having to hold it with hands. Some embodiments of the invention provide an expandable shaft chamber that is inflatable to push a massage surface towards the G-spot or prostate of the user to increase contact pressure in that area. This inflation can also allow for a hands-free experience (meaning the user can take hands off of the device once positioned without the device falling out of the vagina or rectum) by expanding the width of the shaft inside the vagina for a snug fit tight against the vaginal or rectum walls. Some embodiments provide an expandable ring chamber that is inflatable to securely hold a massager device inside the vagina or rectum, allowing for a hands-free experience.

The user, therefore, can enjoy the feeling of the massager without worrying about holding it. In some embodiments, the massage component is unpowered, and in other embodiments, the massager has a vibrator, g-spot massage device, or other powered massage component.

Reference throughout this specification to "one embodiment," "an embodiment," "some embodiments", "embodiments," or similar language means that a particular feature, structure, or characteristic described in connection with the embodiment is included in at least one embodiment of the present invention. Thus, appearances of the phrases "in one embodiment," "in an embodiment," "in some embodiments", "in embodiments," and similar language throughout this specification may, but do not necessarily, all refer to the same embodiment.

The terminology used herein is for the purpose of describing particular embodiments only and is not intended to be limiting of this disclosure. As used herein, the singular forms "a", "an", and "the" are intended to include the plural forms as well, unless the context clearly indicates otherwise.

Furthermore, the use of the terms "a", "an", etc., do not denote a limitation of quantity, but rather denote the presence of at least one of the referenced items. The term "set" is intended to mean a quantity of at least one. It will be further understood that the terms "comprises" and/or "comprising", or "includes" and/or "including", or "has" and/or "having", when used in this specification, specify the presence of stated features, regions, integers, steps, operations, elements, and/or components, but do not preclude the presence or addition of one or more other features, regions, integers, steps, operations, elements, components, and/or groups thereof.

For the purposes of disclosure, the word, "substantially" is defined as "for the most part". It means "to a great extent," but having some room for some minor variation.

For the purposes of disclosure, the words "width," "girth," and "volume" refer to the general space occupied by embodiments since the shaft can be, but does not have to be, completely round in a direction perpendicular to its longitudinal axis.

Moreover, the described features, structures, or characteristics of the invention may be combined in any suitable manner in one or more embodiments. Features, structures, or characteristics of one embodiment can be mixed and matched with features, structures, or characteristics of another embodiment. It will be apparent to those skilled in the art that various modifications and variations can be made to the present invention without departing from the spirit and scope and purpose of the invention. Thus, it is intended that the present invention cover the modifications and variations of this invention provided they come within the scope of the appended claims and their equivalents. Reference will now be made in detail to the preferred embodiments of the invention.

FIG. 1A shows a side view of an insertable portion 100 of a device in accordance with embodiments of the present invention in a contracted (deflated) configuration. In FIGS. 1A-1E, an exterior sheath, except a portion thereof represented at 157, is removed for clarity. Line 199 represents a break line where the insertable portion 100 can interface with another portion. Insertable portion 100 comprises a shaft 102 that is insertable into a vagina, or rectum via the anus. The shaft 102 is comprised of a substantially rigid material such as plastic, metal, or other suitable material. The shaft 102 has a first side 103 and a second side 105. The first side 103 comprises a massage surface 159*b* (which is external side of a sheath 157 along a path of a roller 104 thereunder) for imparting stimulation from a stimulator (i.e. "massage component"), represented generally as 111, to a G-spot or prostate of a user. Sheath 157 has surface 159*a* under which stimulator operates. The roller traverses surface 159*a* of sheath 157. The roller 104 may roll over the underside to reduce friction from otherwise rubbing. The enclosure, threaded post, and roller are sized such that, during operation, the roller remains within the opening of the enclosure, and does not travel around the threaded post in between the interior walls of the enclosure. In embodiments, the first side 103 and the second side 105 are disposed opposite, or substantially opposite, one another.

In some embodiments, the stimulator 111 has a roller 104 that is configured and disposed to stimulate the G-spot or prostate of a user. In some embodiments, the stimulator 111 is electromechanical. In some embodiments, the roller 104 is a roller disposed to traverse a path along, or in alignment with, a longitudinal axis A of the shaft 102. In some embodiments, the roller 104 is a roller disposed to traverse a path substantially along, or in substantial alignment with, a longitudinal axis A of the shaft 102. This creates a "come hither" like motion with the roller 104 moving back and forth along a length of the enclosure 211, imitating movement of a finger. In some embodiments, the stimulator 111 can be of another mechanism to impart massage/stimulation to the user. In some embodiments, the insertable portion includes a mechanism other than stimulator 111 shown herein (e.g., stimulator 1411 of FIG. 14) to impart massage.

In embodiments, the second side 105 of insertable portion 100 comprises an expandable shaft chamber 108. In some embodiments, the expandable shaft chamber 108 is an inflatable pneumatic chamber. The shaft chamber 108 can be expanded per the preference of the user. When it is pneumatic, the chamber 108 is expandable by inflation. In embodiments, the inflatable shaft chamber 108 is comprised of elastic material. "Elastic material" herein is a material that is expandable by force (such as air), but returns to its original size when the force (e.g., of the air) is removed. In some embodiments, the elastic material is silicone, rubber, TPE, or other suitable material.

During use in a vagina, inflation of the inflatable shaft chamber 108 provides pressure on the posterior wall of the vagina, thereby pushing the massage surface 159*b* closer to the anterior side of the vagina, where the G-spot is located. This adds pressure for the stimulator 111 (e.g., roller 104) to impart stimulation. It also secures the massager device's insertable portion 100 in the vagina for hands-free operation in some bodies. During use inside of a rectum, as the shaft chamber 108 is inflated, it urges the massage surface 159*b* towards the prostate of the user, providing increased contact pressure of the massage surface 159*b* against the prostate of the user.

In some embodiments, the inflatable shaft chamber 108 is not disposed on, and does not inflate, the first side 103 of the shaft 102. In some embodiments, the inflatable shaft chamber 108 does not extend around an entire exterior of the shaft. In some embodiments, the massage surface 159*b* is not expandable, except by roller 104. In some embodiments, the area of sheath 157, where massage surface 159*b* located, is not inflatable.

Still referring to FIG. 1A, in some embodiments, the insertable portion 100 comprises an expandable ring chamber 106. In some embodiments, the ring chamber 106 is an inflatable pneumatic chamber. In embodiments, the ring chamber 106 is disposed on the insertable shaft 102 in between the massage surface 159*b* and a handle, arm, or other manually manipulatable portion disposed below break line 199. In some embodiments, the inflatable ring chamber 106 is comprised of elastic material. In some embodiments, the elastic material is silicone, rubber, TPE, or other suitable material.

In some embodiments, rather than two chambers, there is only one chamber included. In some embodiments, there is only a shaft chamber 108 without another inflatable chamber. In some bodies, inflation of the shaft chamber 108 allows for a hand-free experience where the massager device will not fall out of the vagina or anus when a user removes their hands. In some embodiments, there is only a ring chamber 106 without another inflatable chamber. The ring chamber 106 stabilizes the device, acting like a wedge in the vagina, which in some bodies, allows for the hands-free experience. When both chambers 108 and 106 are included, the device allows for hands-free use, and enhanced stimulation (due to the pressure induced by shaft chamber 108).

Each of the chambers described herein allow room on the massager device for an unobstructed massage surface (e.g., 159*b*) to interface with a body of the user. Inflation chambers on the device under the massage surface 157 could deaden some of the massage action, vibration, pulsation, oscillation etc. generated by the stimulator before it gets transferred to the G-spot or prostate. The configuration of the expandable chambers herein, whether both or only one included, leaves room on the massager device for a massage surface, having a stimulator or portion of a stimulator (such as a roller) thereunder, to impart stimulation without interference of the chambers.

Figure 1B:
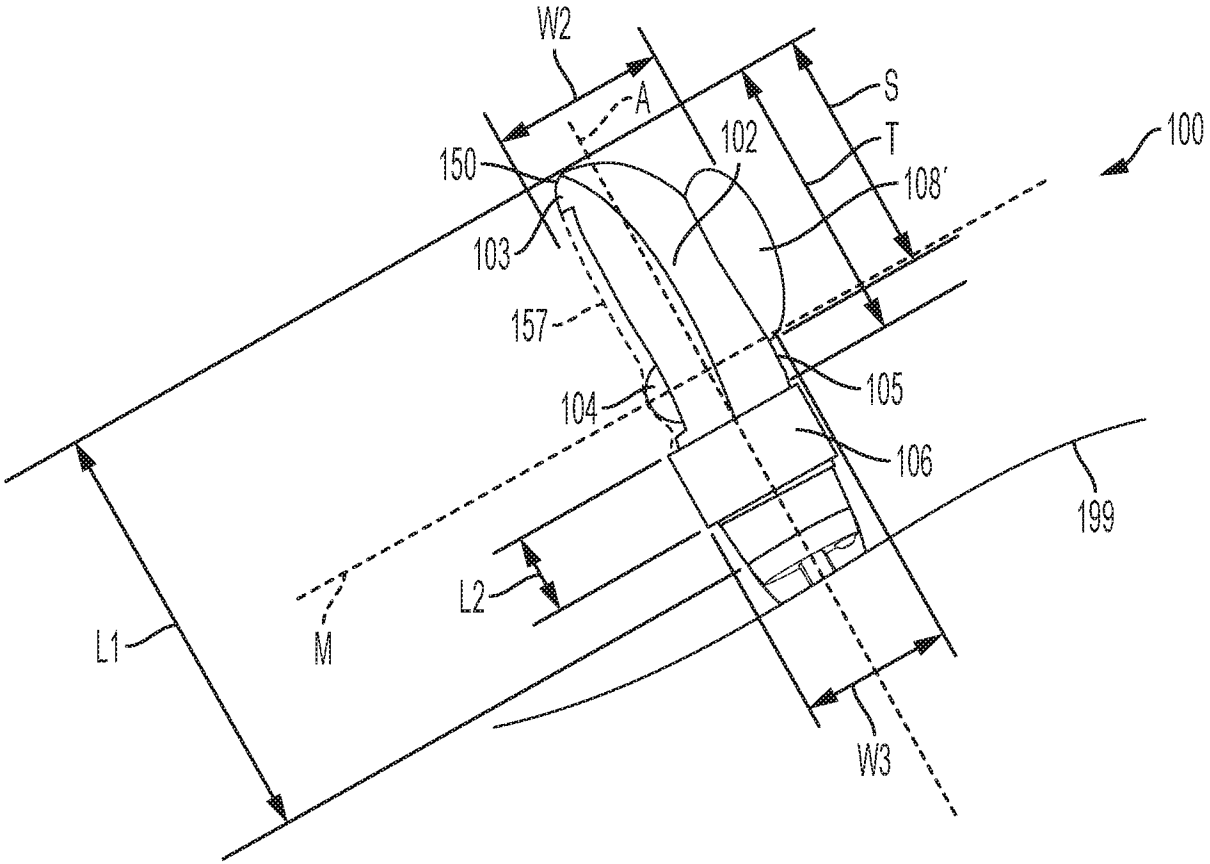
FIG. 1B shows a side view of an insertable portion in accordance with some embodiments of the present invention.
Figure 1C:
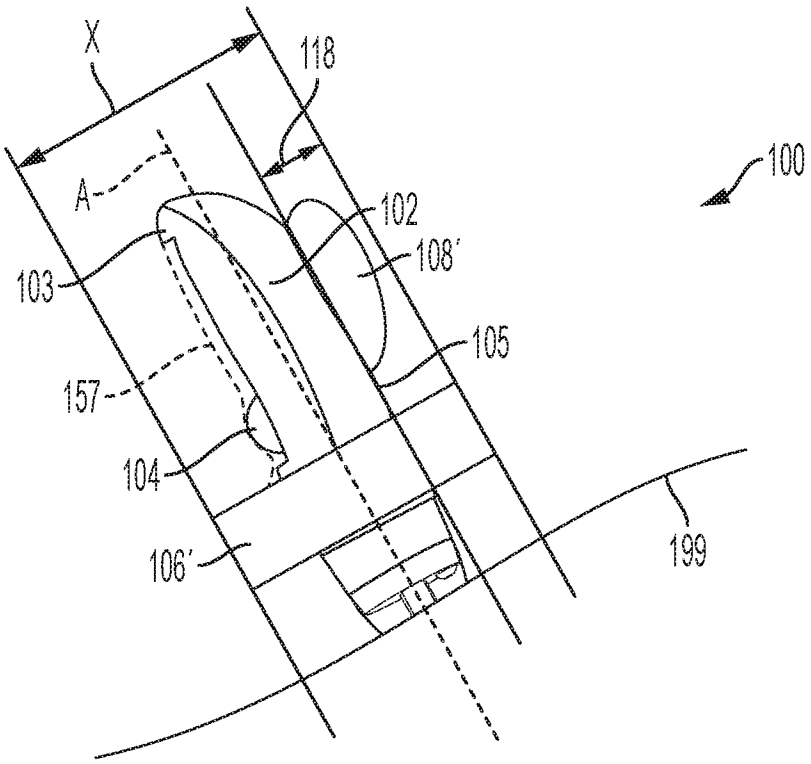
FIG. 1C shows a side view of insertable portion in accordance with some embodiments of the present invention.

FIG. 1B shows a side view of insertable portion 100 in accordance with embodiments of the present invention with the shaft chamber 108' inflated with air from a pump. FIG. 1C shows a side view of insertable portion 100 in accordance with embodiments of the present invention with both the ring chamber 106' and the shaft chamber 108' each inflated. During operation, a user would typically insert an embodiment including insertable portion 100 into the vagina or anus in a deflated configuration as depicted in FIG. 1A, and then choose to inflate to a preferable size as shown in FIGS. 1B and 1C.

In some embodiments, the expandable shaft chamber 108 and the expandable ring chamber 106 are operable independently of one another. The user may choose, via a user interface, to inflate one or both of the inflatable chambers. For example, a user may inflate the shaft chamber 108 to a desired inflated size as shown as 108' in FIGS. 1B and 1C. A user may choose also to inflate the ring chamber 106 to a desired inflated size as shown as 106' in FIG. 1C. In some embodiments, expansion of the chambers is synchronized such that a user can inflate or deflate the shaft chamber and ring chamber simultaneously via a single control (such as a button, etc.).

Figure 1D:
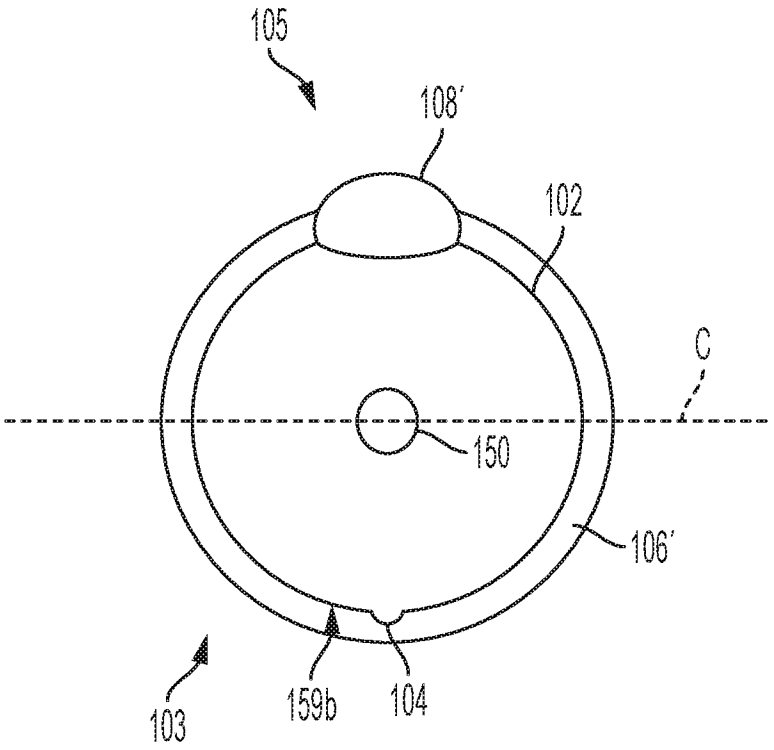
FIG. 1D shows a top-down representation of the insertable portion.

FIG. 1D shows a top-down representation of the insertable portion 100 from direction 117 of FIG. 1A with the shaft chamber 108' and ring chamber 106' inflated. An exterior sheath is removed for clarity. In some embodiments, the shaft 102 has a cross-section C disposed perpendicular to a longitudinal axis A of the shaft 102 (shown in FIG. 1C). In some embodiments, the cross-section C defines the first side 103 and the second side 105, "cutting" along a substantially 180 degree line. Massage surface 159*b* is disposed on first side 103, and shaft chamber 108' is disposed on the second side 105. A protrusion of roller 104, for imparting stimulation, is shown above ring chamber 106'. Ring chamber 106' extends 360 degrees around the shaft 102.

Referring now again to FIG. 1B, there is shown a side view of an insertable portion 100 with shaft chamber 108' inflated. The ideal shape for increasing force (pressure) on a user's G-spot is a larger shape change (due, e.g., to inflation) towards the insertable tip 150 of the massager device with a gradual reduction in shape change extending further down the longitudinal axis. In some embodiments, the expansion of the shaft chamber 108 only changes the cross-section width of the massager device between a tip 150 and a substantial midpoint M of the shaft length L1, the portion being represented as S. In other embodiments, the cross-section width can be expanded only between the tip 150 and ⅔ of the length of L1 from the tip 150 of the shaft 102, the portion represented as T.

Now also referring to FIG. 1A, the width of shaft 102 in contracted (i.e. unexpanded) state is W1. The shaft has a length L1 that is greater than its unexpanded width. As shown in FIG. 1B, the largest width of the expanded portion of shaft 102 in the expanded state is W2, and the smallest width of the expanded portion of shaft 102 is W3. Preferably, the increase in cross section width of the massager device towards the tip 150 of the shaft 102, indicated as W2, is approximately twice as much as the increase in the cross-section width increase at the midpoint M of the length of the shaft 102 of the device. In some embodiments, W1 is a value ranging from 3 centimeters to 8 centimeters, and W2 is a value ranging from 0.5 centimeter to three centimeters more than W1. In some embodiments, W1 is half the value of W2. These values are examples and other suitable values are included within the scope of the invention.

Now referring to FIGS. 1B and 1C, the ring chamber 106' has an expansion thickness 118 which is the difference indicated between the deflated and inflated configurations. In some embodiments, the ring chamber 106' has an expansion thickness ranging between one centimeter and two centimeters. In some embodiments, the total width X of shaft 102 with the ring chamber expanded could be between 3 cm and 6 cm. In some embodiments, ring chamber 106 has a length L2 that is between 1 cm and 2 cm. In some embodiments L2 is ¼ of L1. In some embodiments, L2 is ⅓ of L1. In some embodiments, L2 is 20% of L1. In some embodiments, the ring chamber has a length L2 to shaft length (L1) ratio ranging from 0.12 to 0.35. These values are examples, and any suitable values are included within the scope of the invention.

Figure 2B:
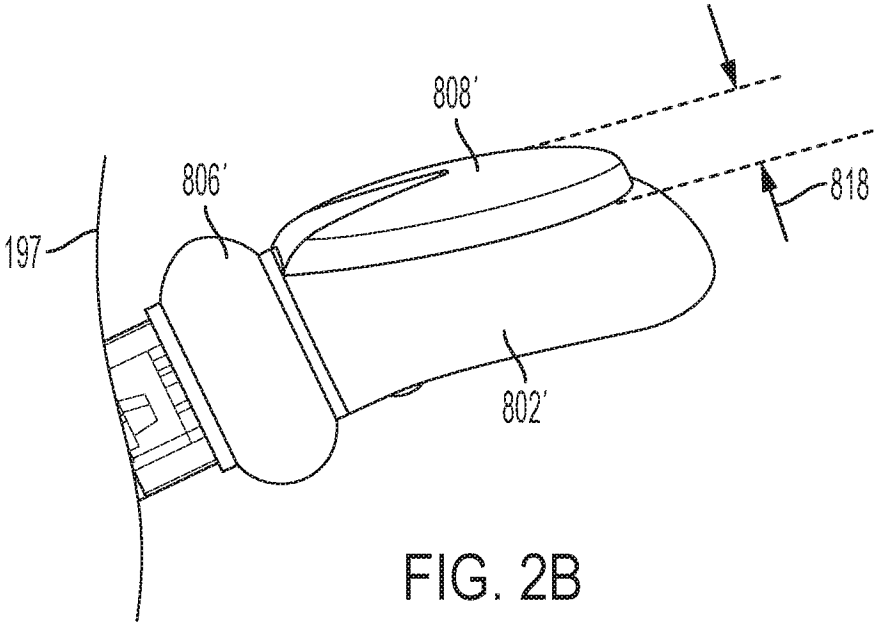
FIG. 2B shows details of the chambers in an inflated configuration.
Figure 2A:
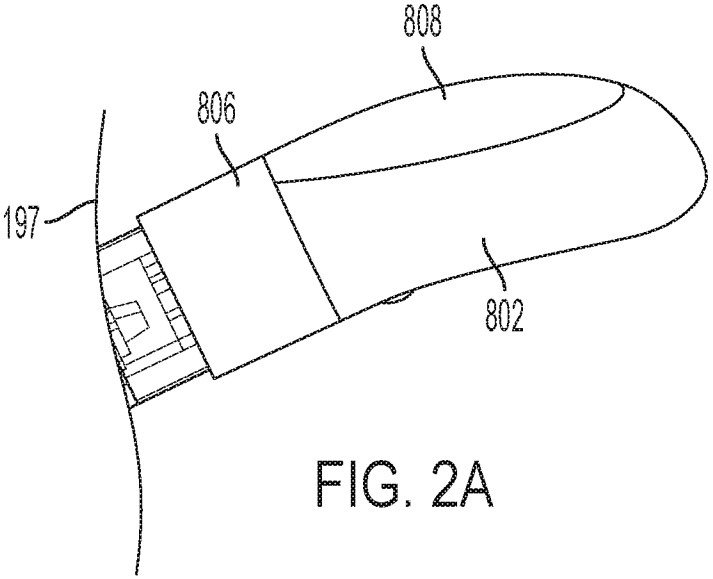
FIG. 2A shows details of the chambers in a contracted, or deflated, configuration.

FIG. 2A shows details of the chambers in a contracted, or deflated, configuration. A portion of the shaft is shown where an interface with another portion is at break line 197. Ring chamber 806 and shaft chamber 808 are both in a deflated configuration on shaft 802. FIG. 2B shows details of the chambers in an inflated configuration. Ring chamber 806' and shaft chamber 808' are both in an inflated configuration on shaft 802. The shaft chamber 808' has an expansion thickness 818 which is the difference indicated between the deflated configuration of FIG. 2A and the inflated configuration of FIG. 2B. In embodiments, the shaft chamber 808' has an expansion thickness ranging between one centimeter and three centimeters. These values are examples and other suitable values are included within the scope of the invention.

Figure 3:
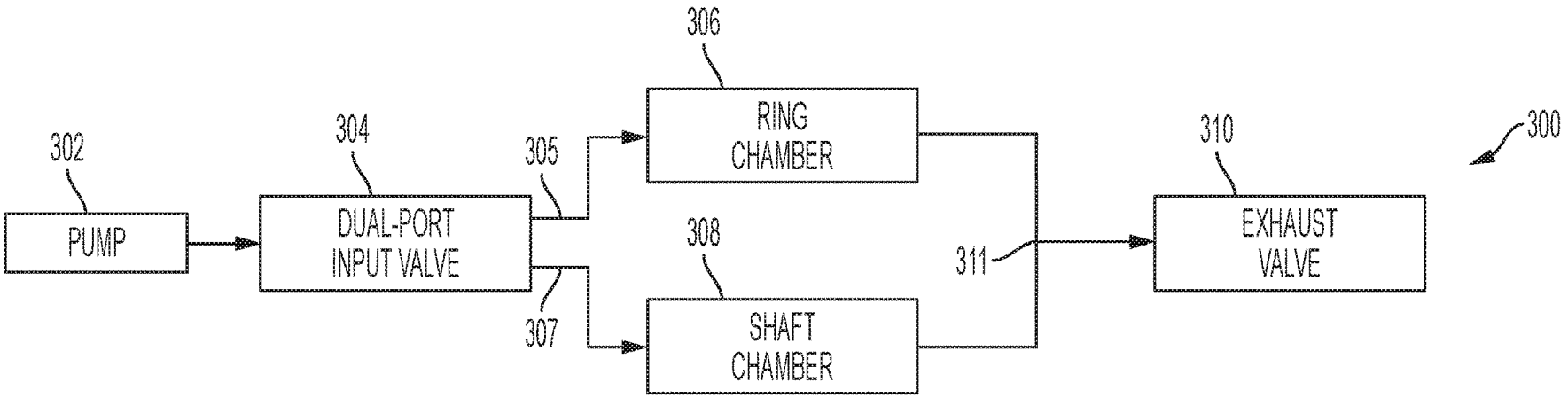
FIG. 3 shows a block diagram 300 of an embodiment of the present invention.

FIG. 3 shows a block diagram 300 of an embodiment of the present invention. Diagram 300 includes a pump 302 which feeds a dual-port input valve 304. In some embodiments, the dual-port input valve is an electronically controlled valve, in that the particular port of the dual-port input valve is selectable via an electronic signal. A first port 307 of the dual-port input valve 304 supplies air to shaft chamber 308. A second port 305 of the dual-port input valve 304 supplies air to ring chamber 306. In embodiments, an exhaust valve 310 is supplied by a T connection 311 that allows both the shaft chamber 308 and the ring chamber 306 to vent through exhaust valve 310. When the user is finished using the device, they can, via user input, contract (deflate) shaft chamber 308 and ring chamber 306 prior to removal by opening the exhaust valve 310. In embodiments, the exhaust valve 310 is electronically controlled (e.g., by pressing a button on a user interface).

In some embodiments, the inflation and/or deflation of one or more of the inflatable chambers and/or the operation of a stimulator is controlled via user input. In some embodiments, the user input is received via an onboard user interface having buttons, or other controls on the massager device.

Figure 4:
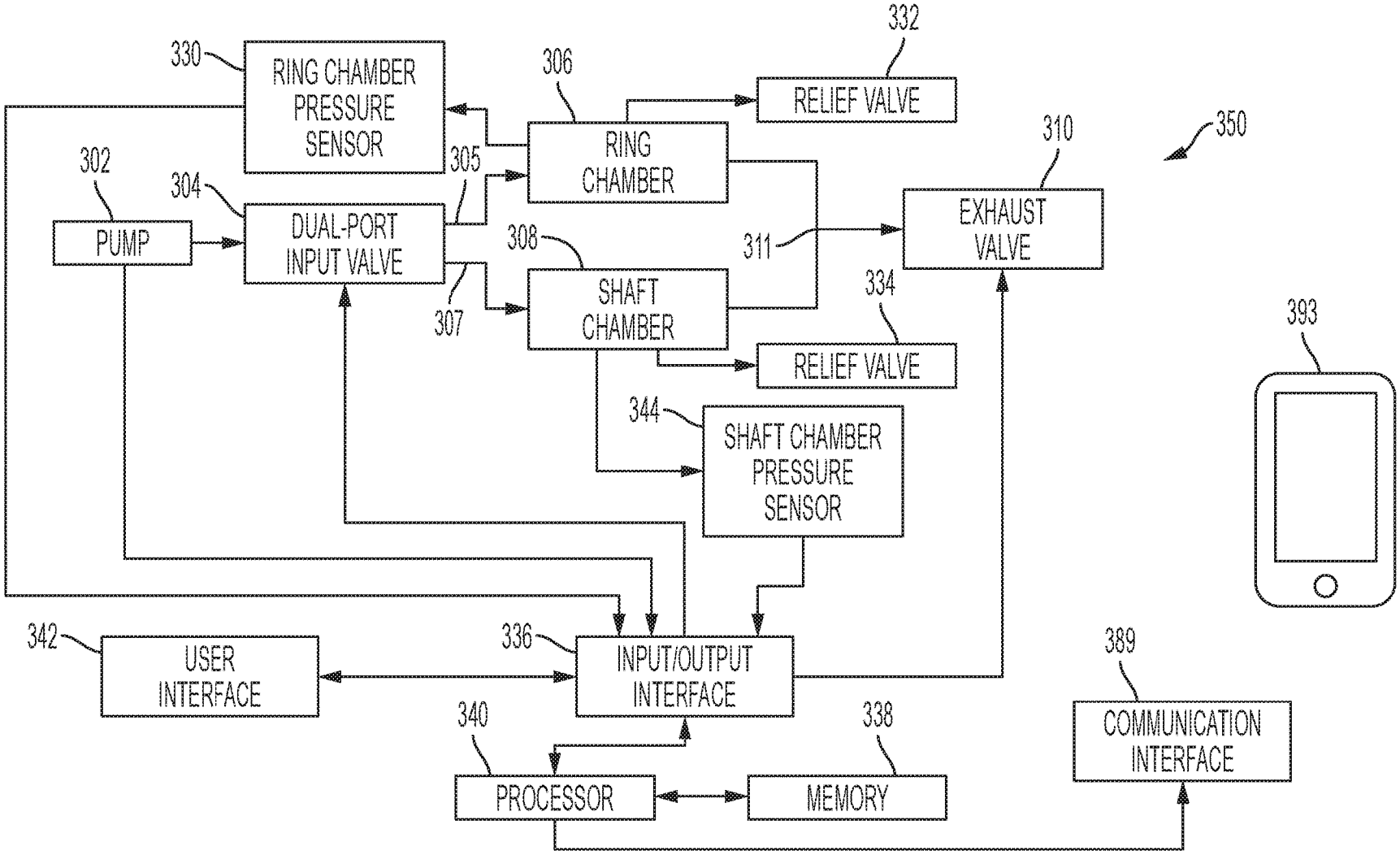
FIG. 4 shows a block diagram of another embodiment of the present invention, which uses pressure sensors to control maximum inflation during use.

FIG. 4 shows a block diagram 350 of another embodiment of the present invention, which uses pressure sensors to control maximum inflation during use. The embodiment of FIG. 4 includes everything from the embodiment of FIG. 3, and further includes additional components. Some embodiments may include some of the components shown in FIG. 3, but may not necessarily include all of the components shown in FIG. 3.

Massager 350 further includes a processor 340, a memory 338 coupled to the processor 340, an input/output (I/O) interface 336 coupled to the processor 340, and a user interface 342 coupled to the I/O interface 336. The memory 338 may include a non-transitory computer readable medium including, but not limited to, flash, EEPROM, static ram (SRAM), or other suitable storage type. The memory 338 contains instructions, that when executed by processor 340, enable embodiments of the present invention. The user interface 342 may comprise one or more buttons, lights, buzzers, liquid crystal displays, and/or other suitable components for control and operation of the massager device.

Massager 350 includes a first relief valve 334 coupled to the shaft chamber 308, wherein the first relief valve 334 is configured and disposed to open in response to reaching a shaft chamber pressure limit (e.g., 30 psi). This can prevent over-inflation of the shaft chamber 308. Thus, embodiments include a first relief valve coupled to the shaft chamber, wherein the first relief valve is configured to open in response to a shaft chamber pressure limit.

Massager 350 includes a second relief valve 332 coupled to the ring chamber 306, wherein the second relief valve 332 is configured to open in response to a ring chamber pressure limit (e.g. 30 psi). This can prevent over-inflation of the ring chamber 306. Thus, embodiments include a second relief valve coupled to the ring chamber, wherein the second relief valve is configured and disposed to open in response to reaching a ring chamber pressure limit.

Massager 350 includes a shaft chamber pressure sensor 344 that is configured to assert a signal on the I/O interface 336. Upon detecting the signal from shaft chamber pressure sensor 344, the processor 340 executes an instruction to stop the pump 302.

Massager 350 includes a ring chamber pressure sensor 330 that is configured and disposed to assert a signal on the I/O interface 336. Upon detecting the signal from ring chamber pressure sensor 330, the processor 340 executes an instruction to stop the pump 302.

In some embodiments, the processor 340 may execute instructions stored in memory 338 that configure the dual-port input valve 304 such that when port 307 is active, pump 302 is activated to inflate the shaft chamber 308 until receiving a signal from ring chamber pressure sensor 344. At that time, the processor 340 executes instructions stored in memory 338 that configure the dual-port input valve 304 such that port 305 is active, then activates pump 302 to inflate the ring chamber 306 until receiving a signal from ring chamber pressure sensor 330. The massager device is then ready for use, inserted and held in place firmly in the vagina or rectum (via the anus) by the inflated chambers. Thus, in embodiments, the memory comprises instructions, that when executed by the processor, inflate the ring chamber first, followed by the shaft chamber. In some embodiments, the memory comprises instructions to inflate the ring chamber first, followed by the shaft chamber.

Some embodiments may further include a communication interface 389. The communication interface 389 may be a wired or wireless communication interface. In some embodiments, the communication interface 389 includes a Bluetooth® interface, Wi-Fi® interface, or other suitable interface. In some embodiments, the inflation of one or more of the inflatable chambers and/or the operation of a stimulator is controlled via user input. In some embodiments, the user input is received via buttons, or other controls on the massager device. In some embodiments, the massager device 350 may be controlled by the user via an application on a smartphone, tablet computer 393, or computer that is communication with the massager 350 via communication interface 389.

Figure 5:
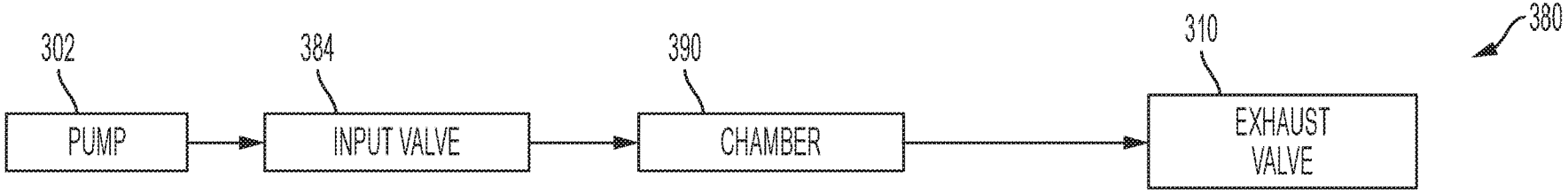
FIG. 5 shows a block diagram of an additional embodiment of the present invention.

FIG. 5 shows a block diagram 380 of an additional embodiment of the present invention. In this embodiment, only one chamber (either the shaft chamber or the ring chamber), represented as 390 is present. Diagram 380 includes a pump 302 which feeds an input valve 384. The input valve 384 provides air to chamber 390. When the user is finished using the massager, they can deflate the chamber 390 prior to removal by opening the exhaust valve 310. In embodiments, the exhaust valve 310 is electronically controlled (e.g. via a user interface). A pressure sensor and other components of FIG. 4 may be included as well within the scope of the invention.

Figure 6:
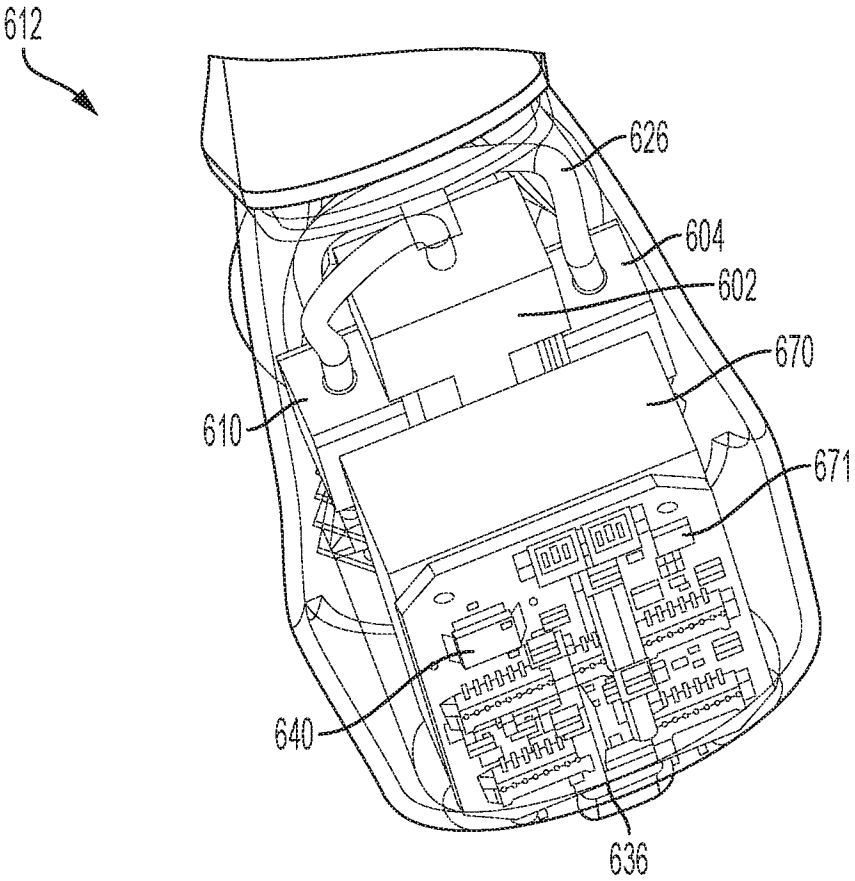
FIG. 6 shows mechanical details of the internal components of base portion of an embodiment of the present invention.

FIG. 6 shows mechanical details of the internal components of base portion 612 of an embodiment of the present invention. In this cutaway view, the exhaust valve 610, pump 602, and dual-port input valve 604 can be seen. The base portion 612 also houses battery 670, processor 640, and input/output interface 636. Pneumatic conduits, an example of which is pointed out at 626, transport air to and from the inflatable shaft chamber and inflatable ring chamber.

In some embodiments, the inflation of the shaft chamber (FIG. 1) is performed by pump 602. In embodiments, the user controls pump 602 to inflate the shaft chamber 108 to a desired inflation setting. The device is calibrated (such as via programmed instructions in the memory via "factory settings") such that the shaft chamber 108 will not break or pop at its most expanded settings.

The ring chamber 106 is inflated in a similar manner to chamber 108 by pump 602. The device is calibrated such that the ring chamber 106 will not break or pop at its most expanded settings.

Battery 670 may be a replaceable, or internally sealed rechargeable battery. In some embodiments, battery may be USB-chargeable, inductively chargeable, or other suitable charging mechanism now known or hereafter developed. It should be recognized that any power source, now known or hereafter developed, may be used.

More than one battery may be included in some embodiments. In some embodiments, the device may be powered by alternating current power, such as 120V or 240V standard household power, with a power adapter comprising voltage regulators to convert the power to an appropriate DC level (e.g. 12V DC).

In some embodiments, the massager device further includes a wireless communication interface 671. The wireless communication interface 671 may include a Bluetooth®, WiFi®, or other suitable interface. The wireless communication interface allows pairing with an electronic device such as a dedicated remote controller, smartphone, tablet computer 393, or other remote-control device. In some embodiments, the electronic device enables a rich user interface display, allowing for more complex programming options. Wireless communication interface 671 may be in communication with a transceiver in the remote-control device. The massager device may be controlled by the user via an application on the smartphone or computer.

Figure 7A:
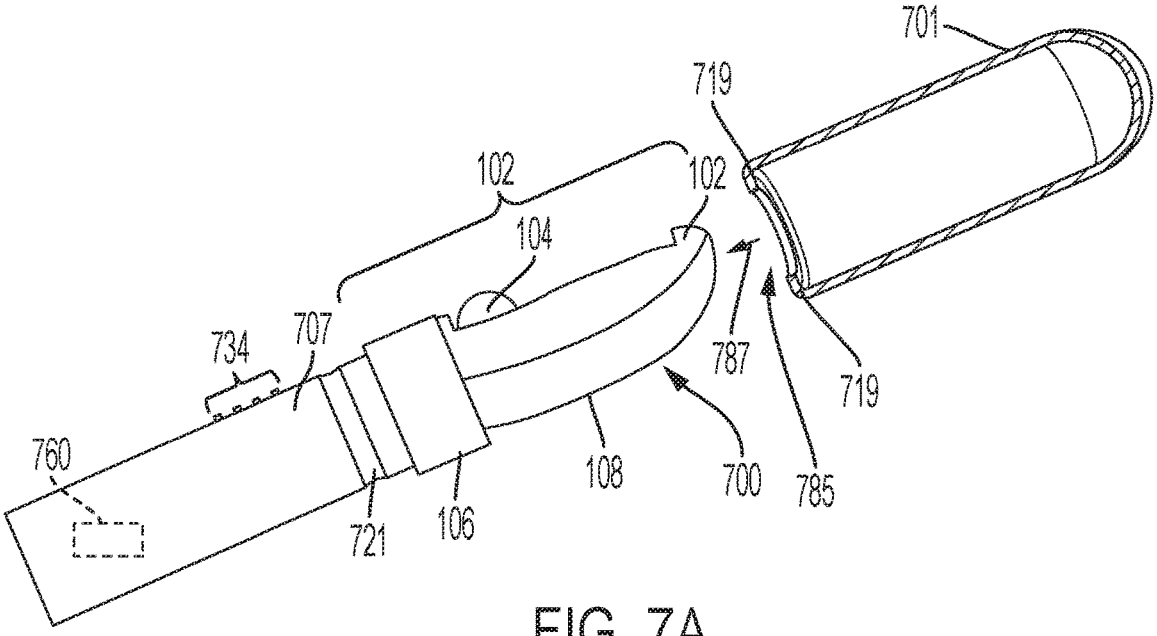
FIG. 7A shows a side view of an embodiment having a handle and a cross-section view of a sheath.

FIG. 7A shows a side view of a device 700 having insertable portion 100, with sheath 701 shown detached and in cross-section view for clarity accordance with some embodiments of the present invention. Base portion of the massager device is a handle 707. In this embodiment, the ring chamber 706 is disposed on the shaft 702 between handle 707 and the massage surface 757. The shaft chamber 708 is disposed on the shaft 702. In some embodiments, components for inflation or user input housed by base 112 may be included within the handle 707 (such as a pump 602 and/or battery 670 of FIG. 6). Such components may be disposed within a hollow cavity or embedded in the substantially rigid material of the handle. These components are shown generally as 760. Handle 707 may be made of plastic, glass, wood, TPE, silicone, or other suitable material. Protrusion 719 extends around the entire cross-section of the sheath 701. When sheath 701 is pulled down in direction 787 over insertable shaft 100 (such that insertable shaft 100 fits up through sheath opening 785), protrusion 719 interlocks with groove 721 on device 700. The reciprocal groove 721 and protrusion 719 may be of a size and configuration that they may hold together by friction fit. In other embodiments, adhesive may be used instead of or in addition to the reciprocal groove and protrusion.

Figure 7B:
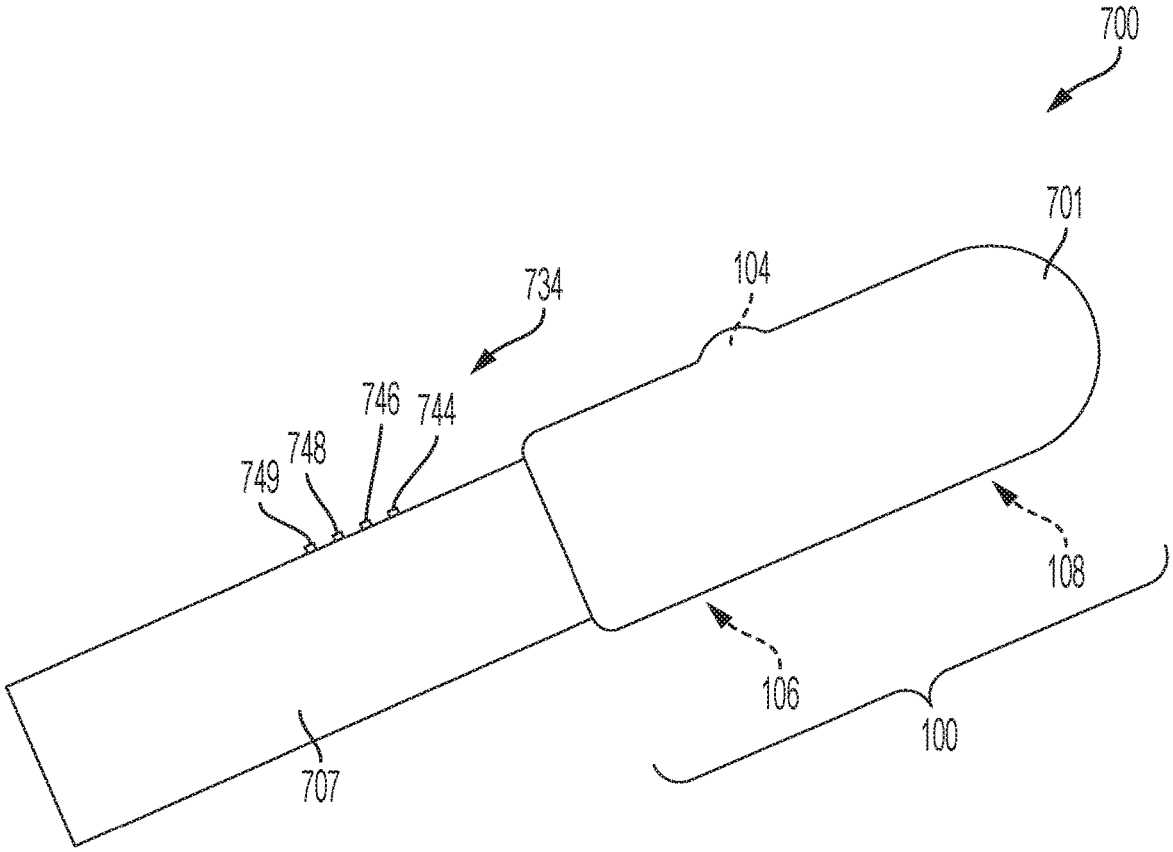
FIG. 7B shows a side view of an embodiment having a sheath thereon.
Figure 7C:
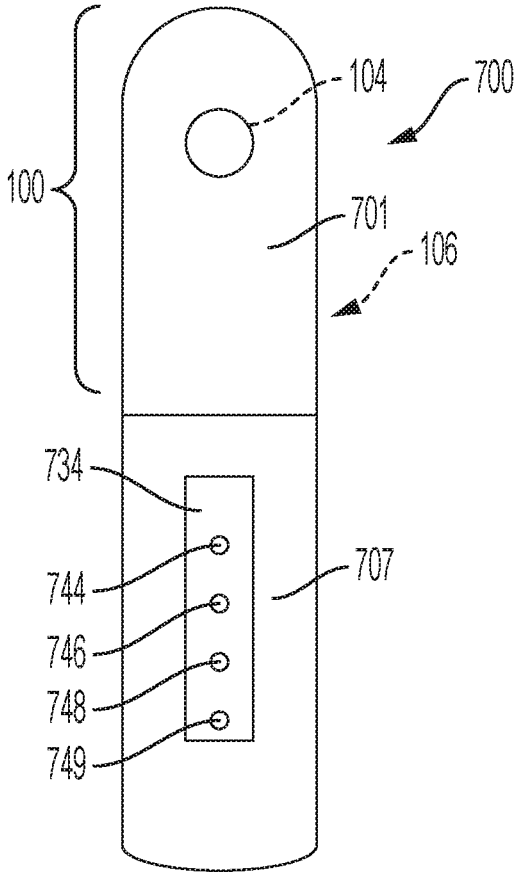
FIG. 7C shows a front view of an embodiment having a sheath thereon.

FIG. 7B shows a side view of a device 700, and FIG. 7C shows a front view of a device 700, each having sheath thereon. Exterior sheath 701 is shown thereon with roller 104 protruding. A user interface 734 is also shown. The user may provide user input to influence the functions of expansion and contraction of chamber 106 and chamber 108 (in some embodiments, inflation and deflation) via a user interface 734. In some embodiments, user interface 734 comprises at least one button or other input device. In some embodiments, user buttons 744, 746, and 748. In embodiments, user button 744 performs inflation, user button 746 is a chamber select button to select which chamber is to be inflated, and user button 748 is used to deflate the chambers. Other user interfaces are possible in embodiments of the present invention. In embodiments, a dedicated power button 742 turns the massager device on and off in a toggle mode of operation. In embodiments, button 749 may power on and allow a user to scan through settings of the speed (of the roller) or other parameter of the stimulator. In some embodiments, in addition to or instead of, the onboard user interface 734, the inflation and deflation (and in some cases, power on and off), as well as the stimulator functions, are remotely controlled by a dedicated remote-control device, or an application run on a smartphone, tablet or computer.

Figure 8:
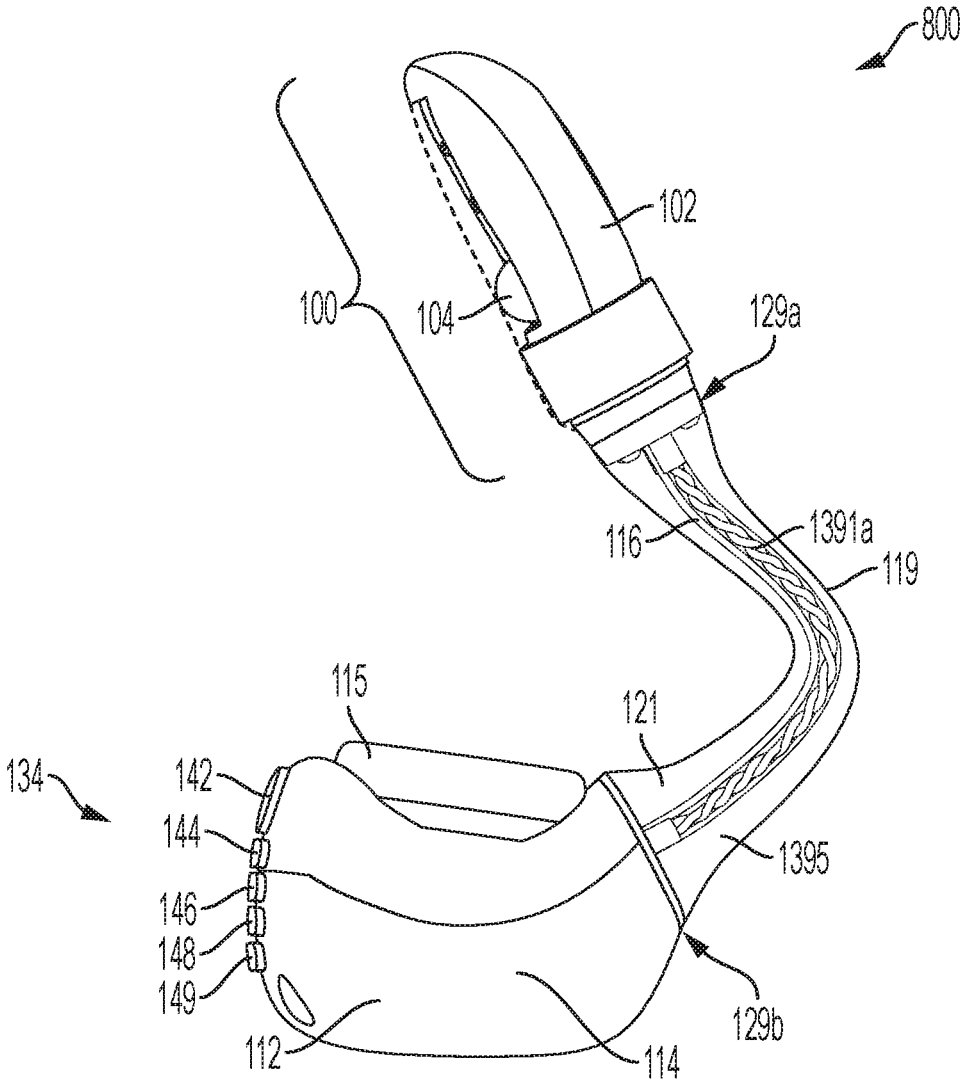
FIG. 8 shows details of an example device in accordance with embodiments having an insertable portion and a base portion, with an exterior sheath removed for clarity.

FIG. 8 shows details of an example device 800 having insertable portion 100 with an exterior sheath removed for clarity. Insertable portion 100 is affixed to a flexible arm 119 on a first end 129*a* of the arm 119, and a base portion 112 is affixed to the flexible arm 119 at a second end 129*b*.

Arm 119 is flexible. The arm is configured to maintain its deformed shape when bent. In some embodiments, arm 119 may be a bendable gooseneck arm. It may have a pliable metal core, such as members 1391*a* and 1391*b* (FIG. 9D), covered in a layer of flexible silicone 1395. Pneumatic conduit 116 can be embedded within the silicone.

The arm 119 may be adjustable in three dimensions—X, Y, and Z.

A base portion 112 may be disposed on the opposite end of the arm 119 from the shaft 102. The base portion 112 may house various internal components, such as pump 602 and/or battery 670. Base portion 112 may further include a clitoral stimulator, shown generally as 114. In some embodiments, the clitoral stimulator 114 may be a pressure-field stimulator that creates, suction, compression, or a combination pressure field thereof in a cup 115 when disposed around a user's clitoris. In some embodiments, the clitoral stimulator 114 may instead, or in addition, include a vibrator, gyrator, pulsator, oscillator, and/or other clitoral stimulation mechanism now known or hereafter developed.

A user interface 134 is also shown. The user may provide user input to influence the functions of expansion and contraction of chamber 106 and chamber 108 (in some embodiments, inflation and deflation) via a user interface 134. In some embodiments, user interface 134 comprises at least one button or other input device. In some embodiments, user buttons 144, 146, and 148. In embodiments, user button 144 performs inflation, user button 146 is a chamber select button to select which chamber is to be inflated, and user button 148 is used to deflate the chambers. Other user interfaces are possible in embodiments of the present invention. In embodiments, a dedicated power button 142 turns the massager device on and off in a toggle mode of operation. In some embodiments, button 149 allows a user to scroll through power and speed settings for the functionality of the roller 104. In some embodiments, in addition to or instead of, the onboard user interface 134, the inflation and deflation (and in some cases, power on and off), and roller functionality are remotely controlled by a dedicated remote-control device, or an application run on a smartphone, tablet or computer.

Figure 9B:
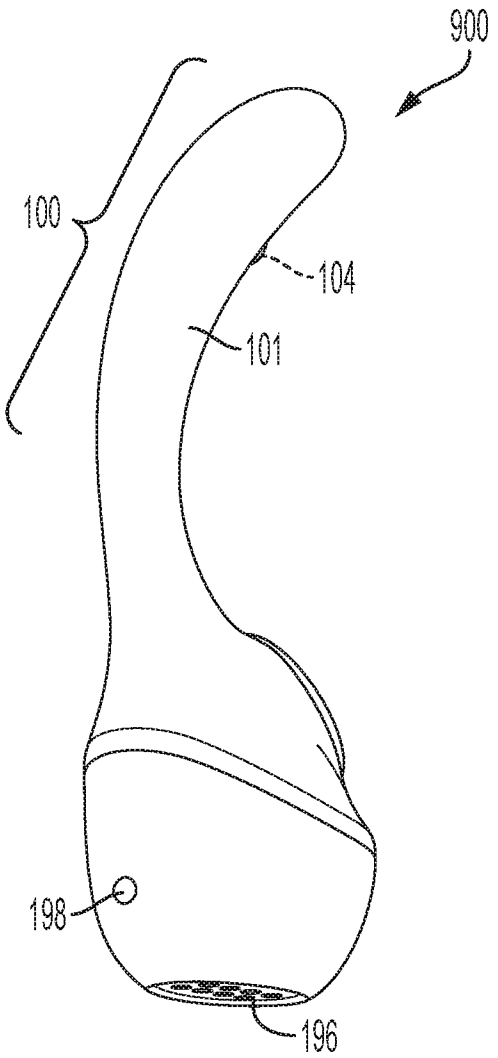
FIG. 9B shows a rear perspective view of an embodiment having an exterior sheath.
Figure 9A:
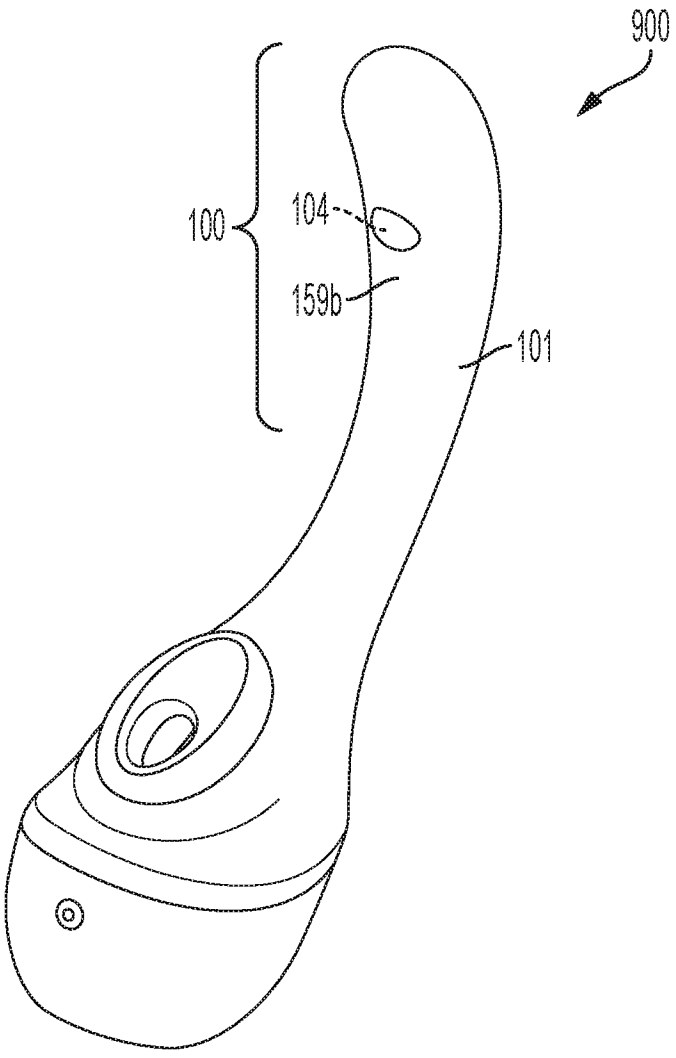
FIG. 9A shows a front perspective view of an embodiment having an exterior sheath.

FIG. 9A shows a front perspective view of a device 900 similar to device 800 having an exterior sheath 101 thereon covering the shaft, roller, shaft chamber, and ring chamber in contracted states. FIG. 9B shows a back perspective view of massager device 900 having the exterior sheath 101 thereon covering the ring chamber 106. The sheath 101 gives the device a substantially smooth exterior with the roller able to protrude during use. In some embodiments, the sheath 101 may include bumps, ridges, or other massage points on its exterior. The sheath 101 is substantially flexible and elastic. Roller 104 is in view adjacent an underside (interior) of sheath 101 in view protruding from beneath the massage surface 159*b*. Massage surface 157 is an exterior portion of sheath 101. The sheath is tightly stretched over the first portion and secured via mechanical means, adhesive or in some other suitable manner.

Figure 9D:
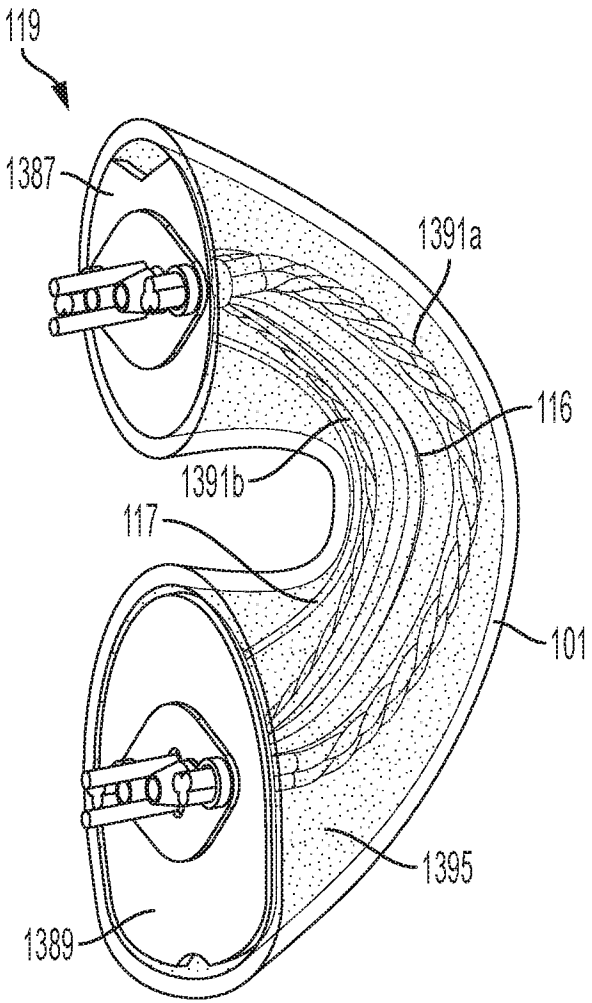
FIG. 9D shows the arm of FIG. 9C with silicone present.
Figure 9C:
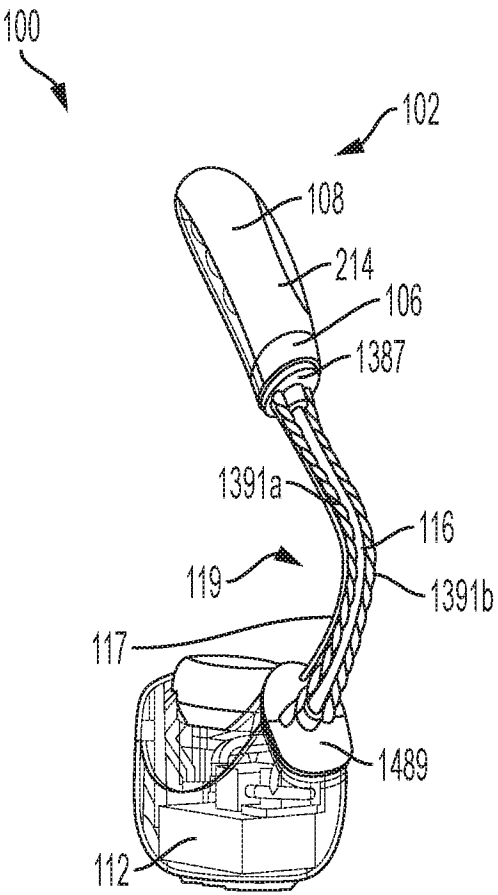
FIG. 9C shows the embodiment of FIGS. 9A and 9B with a silicone layer and sheath removed for clarity.

FIG. 9C shows the embodiment of FIGS. 9A and 9B with the silicone layer 1395 (shown in FIG. 9D) and sheath (outer layer) 101 removed from the arm 119 for clarity. FIG. 9D shows arm 119 with silicone present. In some embodiments, there is an arm, which is an adjustable connection arm 119 connecting the shaft 102 and base 112. The arm is flexible such that it will hold its shape when bent. As shown, arm 119 has a flexible core, which may be flexible members 1391*a* and 1391*b*. Flexible members 1391*a* and 1391*b* may each comprise two twisted wires made of steel, copper, or other suitable material. Pneumatic conduit 116 that supplies air to the inflatable chambers, may be embedded within silicone layer 1395, extending between the shaft 102 and the base 112. Conduit 116 may be made of soft plastic or another suitable material. In some embodiments, sheath 101 may be disposed on top of layer 1395. Layer 1395 may have a shore durometer of Shore A1 and Shore A2, and sheath 101 may have a shore durometer of between Shore A1 and Shore D40. A first plate 1387 is an interface with shaft 1319 and a second plate 1389 is an interface with base 1312. In some embodiments, one or more electrical wires 117 extend through layer 1395 to, for example, provide power from a battery to the shaft stimulator (roller) motor. Conduit 116 may be disposed to extend through holes in the plates 1387 and 1389. Plate 1387 and plate 1389 may be made of metal, plastic, or other suitable material. Conduit 116 extends through holes in the plates 1387 and 1389 to extend into shaft 102 and base 112. One or more electrical wires 117 extend through holes in the plates 1387 and 1389 to extend into shaft 102 and base 112. In some embodiments, plate 1387 and 1389 may not be present. The arm is bendable in the X-Y-Z dimensions.

Embodiments of the arm not limited to the components shown herein. In some embodiments, more than two flexible members may be included. In some embodiments, only one flexible member may be included. In some embodiments, flexible member may each include only a single wire, or more than two twisted wires.

Figure 10:
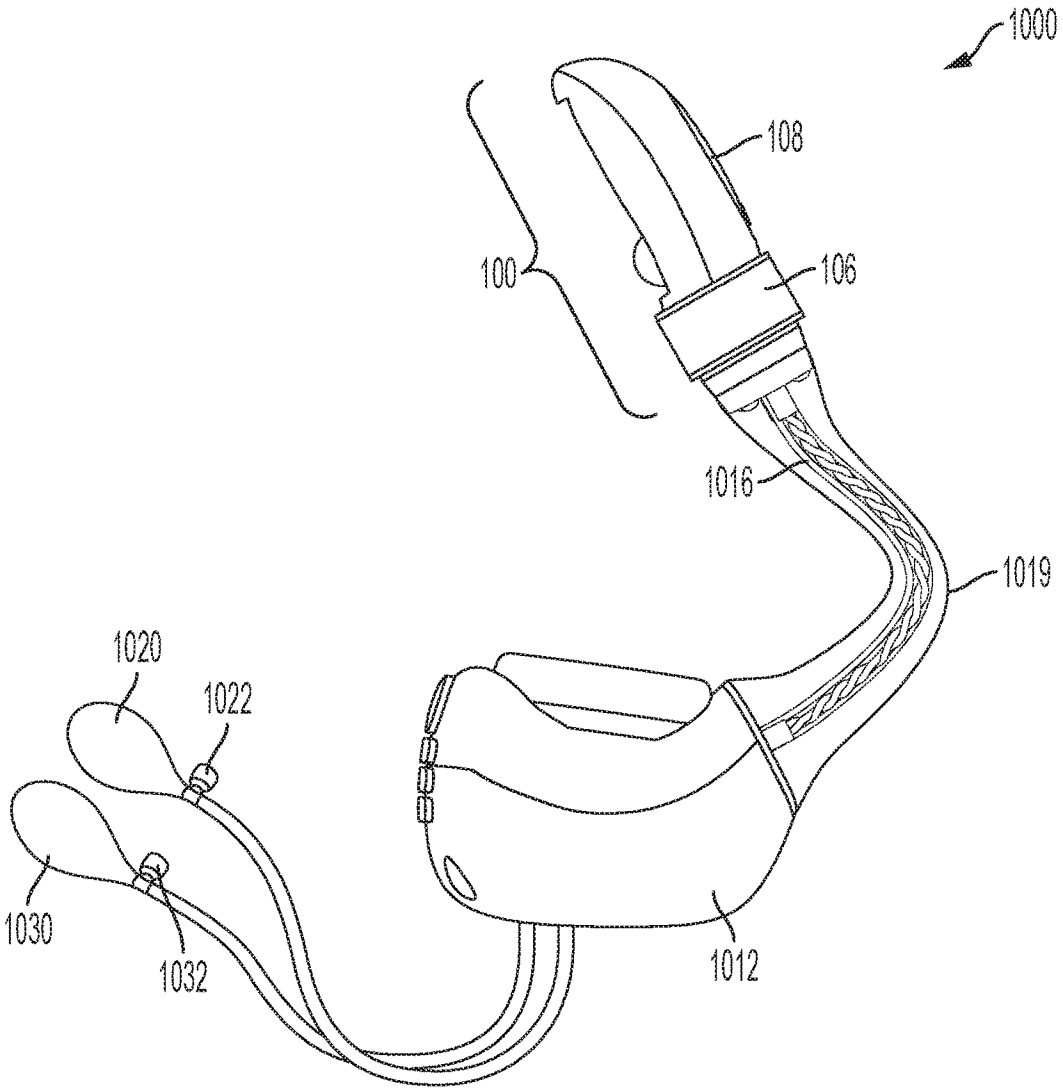
FIG. 10 shows a massager device in accordance with alternative embodiments of the present invention utilizing manual pumps.

FIG. 10 shows a massager device 1000 in accordance with alternative embodiments of the present invention utilizing manual pumps. Insertable portion 100 is included. A flexible arm 1019 similar to arm 119 is in between base portion 1012 and insertable portion 100. An exterior sheath is removed for clarity but fill (1395) is shown transparently. In this embodiment, at least one manual pump is used. In some embodiments, pump 1030 is configured and disposed to inflate the shaft chamber 1008. In embodiments, the user squeezes the pump 1030 to inflate the shaft chamber 108 via conduit 1016 traversing through arm 1019. The user operates manual shaft chamber release valve 1032 (e.g. by turning a knob) to deflate the shaft chamber 108. Similarly, in some embodiments, pump 1020 is configured and disposed to inflate the ring chamber 106. In embodiments, the user squeezes the pump 1020 to inflate the ring chamber 106. Thus, in embodiments, the pump is a manually operated pump. The user operates manual ring chamber release valve 1022 (e.g. by turning a knob) to deflate the ring chamber 106. Thus, in embodiments, the exhaust valve comprises a manual release.

Figure 11C:
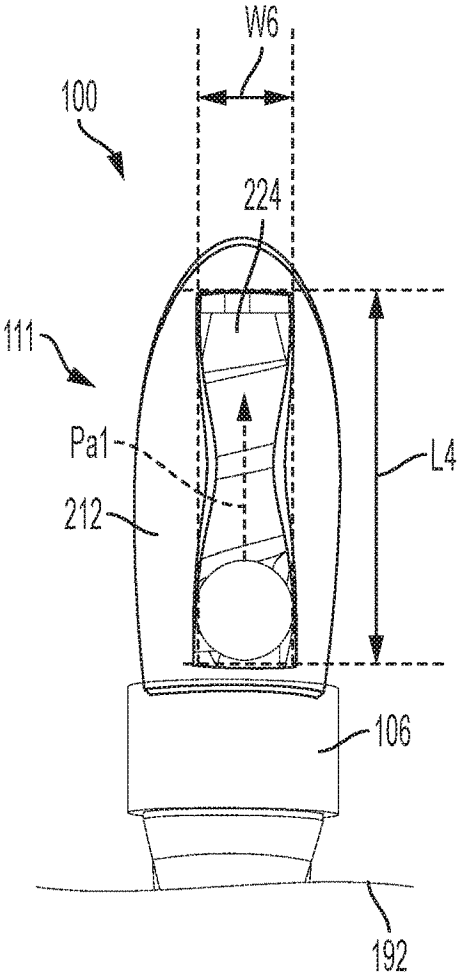
FIG. 11C is a front view of the insertable portion of FIG. 11A in accordance with embodiments of the present invention showing detail of the enclosure upper portion.
Figure 11B:
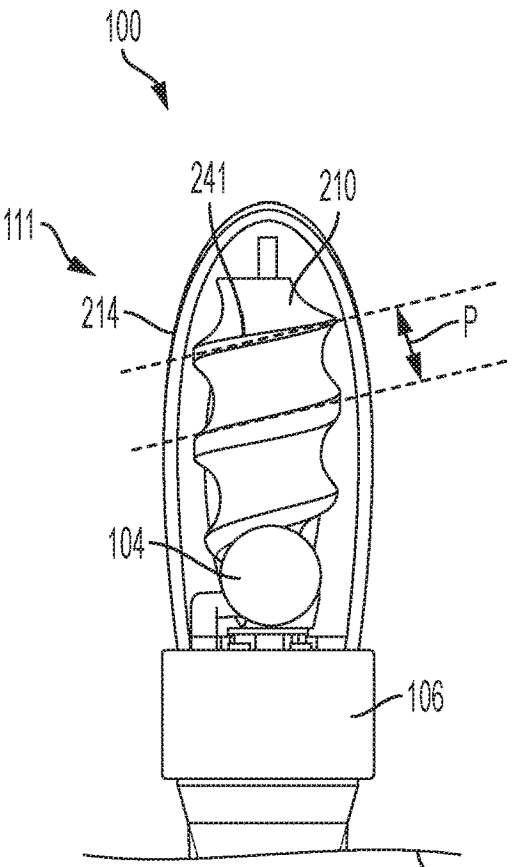
FIG. 11B is a front view showing detail of the insertable portion of FIG. 11A.
Figure 11A:
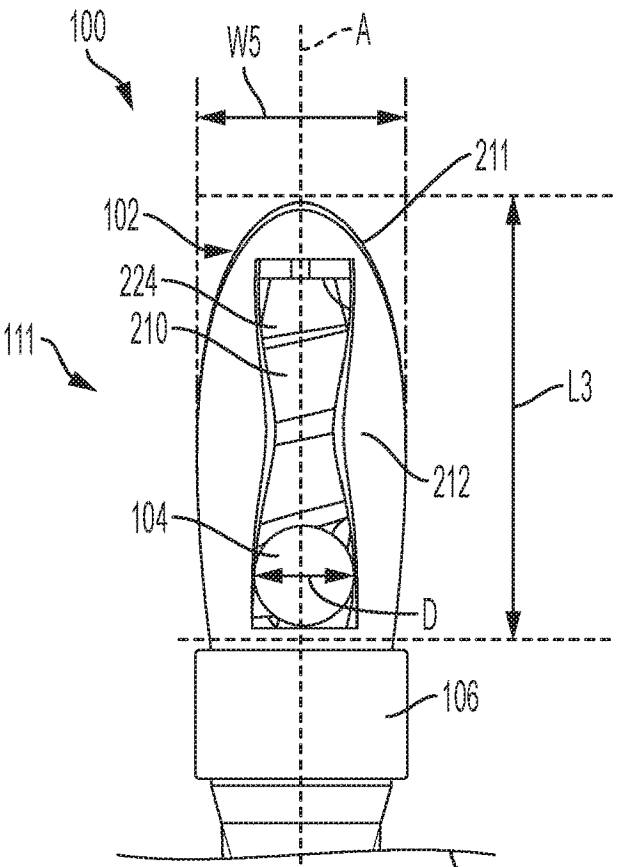
FIG. 11A is a front view showing detail of an insertable portion having a roller stimulator in accordance with some embodiments of the invention.

FIG. 11A is a front view showing detail of an insertable portion 100 having example stimulator 111 (with sheath removed for clarity) in accordance with embodiments of the present invention as viewed from the direction of arrow 178 of FIG. 1. Break line 192 represents where the insertable portion interfaces with an arm or handle (or other base).

Referring now also to FIGS. 11B-11F, in embodiments, the shaft 102 has enclosure 211. In some embodiments, enclosure 211 is comprised of an enclosure first portion 214 and an enclosure second portion 212. Although shown as two portions, in some embodiments, the enclosure may comprise only a single one-piece contiguous portion or more than two portions. In embodiments, the enclosure is substantially rigid, made from plastic, metal, glass, or other suitable material. The roller 104 protrudes outside the enclosure through an opening 224 in the enclosure 211.

In some embodiments, the roller 104 is spherical or other suitable shape. In FIGS. 11A-11F, an exterior sheath is removed for clarity. The roller 104 has a width D. In some embodiments, D ranges from 12 millimeters to 30 millimeters. In some embodiments, D ranges from 19 millimeters to 24 millimeters. The roller 104 may be comprised of metal, plastic, composite, hard rubber, or other suitable material. In some embodiments, the shaft 102 is one and the same with enclosure (as shown). In other embodiments, the shaft includes the enclosure and additional components. The enclosure 211 is an elongate shape having a length L3, and a width W5, where L3 is greater than W5. In some embodiments, L3 has a value in the range from 8 centimeters to 17 centimeters, and W5 has a value in the range from 3 centimeters to 7 centimeters. In some embodiments, roller 104 is disposed to traverse a path, along or in alignment with, longitudinal axis A of the elongate shape of the enclosure. In some embodiments, roller 104 is disposed to traverse a path, substantially along or in alignment with, the elongate shape of the enclosure 211. This creates a "come hither" like motion with the roller 104 moving back and forth along a length of the enclosure 211.

FIG. 11B is a front view showing detail of an insertable portion 100 having example stimulator 111 in accordance with embodiments of the present invention with the enclosure first portion removed to illustrate additional parts. In this view, the threaded post 210 is shown. The threaded post has threads 241. The threads are a protrusion that extend around the elongate core of the threaded post like a screw. The threads have a pitch P. The pitch P corresponds to the width D of the roller 104. The roller 104 is disposed within the plurality of threads. During operation, a motor rotates the threaded post in an alternating clockwise and counterclockwise motion (or vis versa), the spherical roller 104 moves along the threaded post to perform a massage stimulation function.

FIG. 11C is a front view of a portion of a massager device in accordance with embodiments of the present invention showing detail of the enclosure portion 212 without a sheath thereon. The enclosure portion 212 has an opening 224 which allows the roller 104 to protrude outside of the enclosure 211. In embodiments, the elastic sheath presses the roller 104 firmly against the threaded post 210, keeping the roller 104 disposed within the threads 241. The opening 224 of the enclosure 211 serves as a guide for the roller 104. The opening 224 has rails, indicated as 293*a* and 293*b*, disposed along two sides of a longitudinal axis of the threaded post with the roller 104 disposed therein between.

As the threaded post 210 rotates, the roller 104 travels along path Pa1 within the length L4 of the opening, which is defined by the rails of opening 224. In embodiments, the roller travels along a linear path. In some embodiments, the opening 224 is of a size such that its maximum width W6 is less than the width D of the roller 104 such that the roller 104 may protrude without being able to completely pass through opening 224.

Figure 11E:
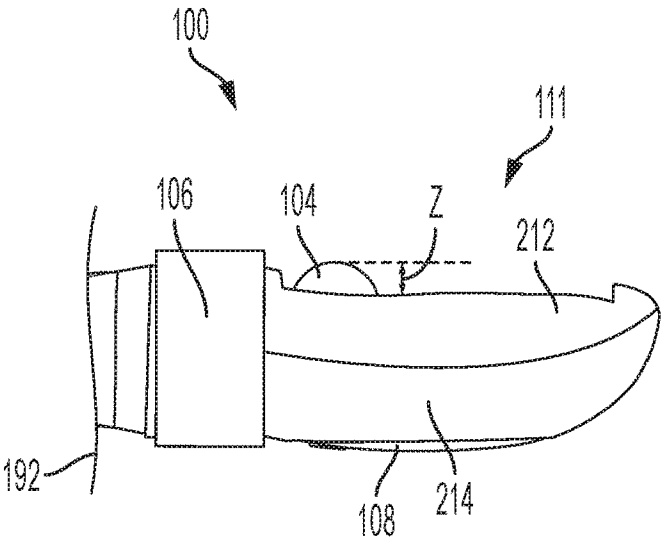
FIG. 11E is a side view showing additional detail of the insertable portion of FIG. 11A.
Figure 11D:
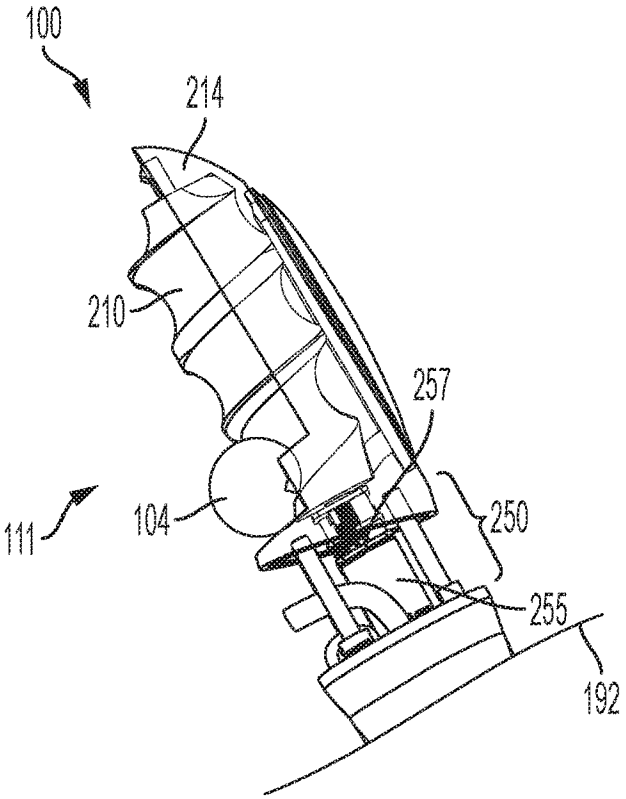
FIG. 11D is a view showing additional details of the stimulator of FIG. 11A in accordance with embodiments of the present invention.

FIG. 11D is a view showing additional details of an insertable portion 100 having example stimulator 111 in accordance with embodiments of the present invention. In this view, the enclosure is removed to show details of an example driver 250. The driver 250 has a motor 255 and an encoder 257. The driver 250 includes the motor, as well as additional mechanical coupling such as shafts, gears, and/or other components for coupling the threaded post to the motor. The motor 255 is an electric motor that operates in a reciprocating manner to alternate between clockwise and counterclockwise rotation. The encoder 257, or other suitable mechanism, may be used for tracking the position of the threaded post 210 relative to an initial "home" position. In some embodiments, the encoder 257 may be integrated into the motor 255.

The motor 255 is mechanically coupled to the threaded post 210.

FIG. 11E is a side view showing detail of an insertable portion 100 having example stimulator 111 in accordance with embodiments of the present invention. In this view, it can be seen that the roller 104 protrudes outside of the enclosure by a protrusion length Z. In some embodiments, the protrusion length S has a value ranging from 8 millimeters to 16 millimeters. In some embodiments, the value may be outside of such example range within the scope of the present invention.

Figure 11F:
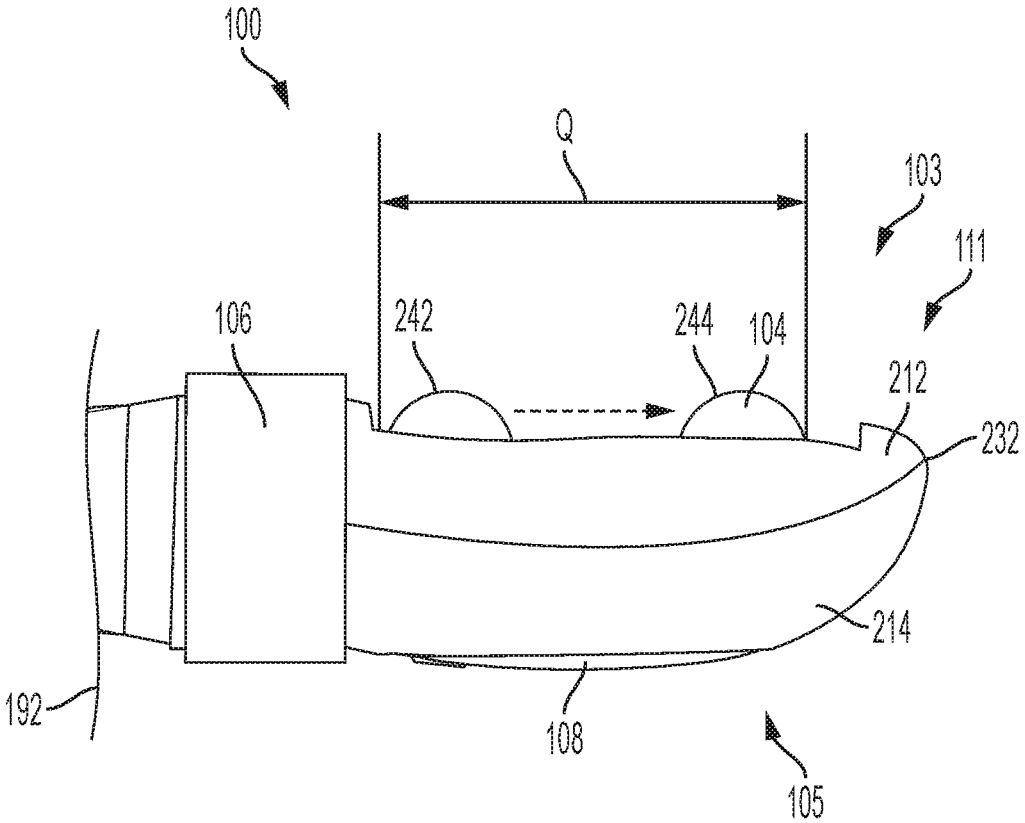
FIG. 11F is a side view showing detail of the stimulator of FIG. 11A with start range and end range positions depicted in accordance with some embodiments of the present invention.

FIG. 11F is a side view showing detail of a start range and end range positions in accordance with some embodiments of the present invention. In some embodiments, a first position 242 is a starting range position, and a second position 244 is the end range position. In some embodiments, the first position 242 is an end range position, and the second position 244 is the start range position. By controlling the amount of rotation of the threaded post, the roller 104 can be made to alternate between the first position 242 and the second position 244, or any intermediate locations between those two positions. As shown, the path Q of the roller 104 traverses a longitudinal axis of the elongate shape between the ring chamber 106 and a tip 232 of the device. The path is disposed on a side 103 of the shaft 102 opposite from the side 105 having the shaft chamber 108.

The opening 224 of the enclosure 211 serves as a guide for the roller 104. In some embodiments, the guide may instead be formed of rails disposed along two sides of a longitudinal axis of the threaded post with the roller 104 disposed therein between. Accordingly, alternative guide structures are included within the scope of the invention.

Figure 11G:
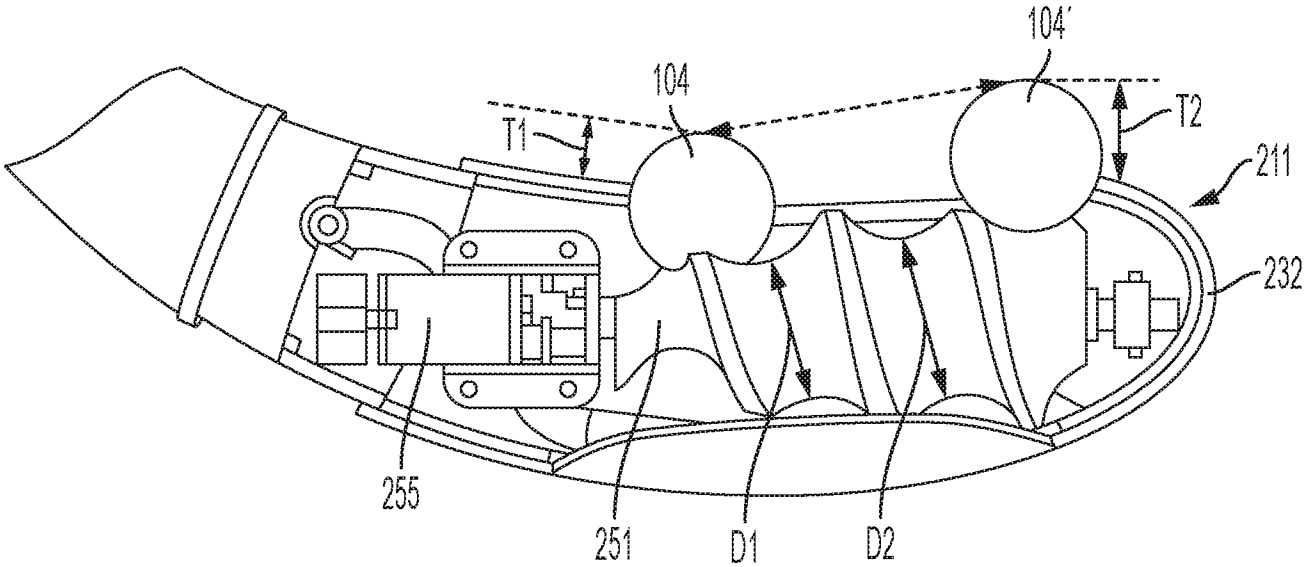
FIG. 11G shows a view of the stimulator of FIG. 11A having a tapered threaded post.

FIG. 11G shows an embodiment of a portion of a massager device having a tapered threaded post, with external sheath removed for clarity. The tapered threaded post 251 has an increasing diameter in the direction towards the enclosure tip 232. In FIG. 3, two diameters are indicated, D1 and D2, where D2 is greater than D1. In embodiments, the diameter of the tapered threaded post 251 may gradually increase over the length of the tapered threaded post. In some embodiments, the tapered threaded post 251 has a minimum diameter ranging from 1 centimeter to 1.5 centimeters, and a maximum diameter of 2 centimeters to 3 centimeters. These values are examples, and any suitable values may be included within the scope of the invention.

During operation, the motor 255 alternates directions periodically to rotate the threaded post 251 in a clockwise direction for a predetermined duration, followed by a counterclockwise direction for a predetermined duration (or vis versa). This causes the I roller 104 to move back and forth between the locations indicated by 104 and 104'. As the spherical roller 104 moves back and forth, the protrusion length changes. The protrusion length is the length that the roller 104 extends beyond the enclosure (through the opening underneath the sheath). At the position indicated by 104, the roller has a protrusion length T1. At the position indicated by 104', the roller has a protrusion length T2. In this embodiment, T2 is greater than T1. This is due to the tapered threaded post 251 being disposed to lower the roller at the position indicated by 104, as compared to the position indicated by 104'. In embodiments, the position indicated at 104 is a home position for the roller. A home position is an initialization position that may be used as part of a power-on sequence. During a power-on sequence, the device may first be brought to its home position. In some embodiments, during a power-off sequence, the device may be returned to its home position. When the device is powered off, the motor 255 operates to return the roller to the position indicated as 104. This can serve to minimize stretching of an elastic sheath that is disposed over the stimulator when the device is not in use, thereby prolonging the life of the device. In embodiments, a processor executes instructions in memory to perform a homing operation prior to shutdown of the device. The homing operation returns the roller to the position indicated as 104 based on encoder input, limit switches, or other suitable position indicating mechanisms and/or techniques.

In some embodiments, the tapered threaded post 251 may be installed in a reverse orientation, such that diameter D1 is greater than diameter D2, and thus, protrusion length T1 is greater than protrusion length T2. The increased protrusion length causes the roller 104 to press harder against the G-spot or prostate area during use. Thus, in the embodiment shown, the applied force of the roller 104 increases as the roller 104 advances towards the enclosure tip 232. In other embodiments, where the threaded post 251 is installed in the reverse orientation, the applied force of the roller 104 decreases as the roller 104 advances towards the enclosure tip 232.

Figure 12:
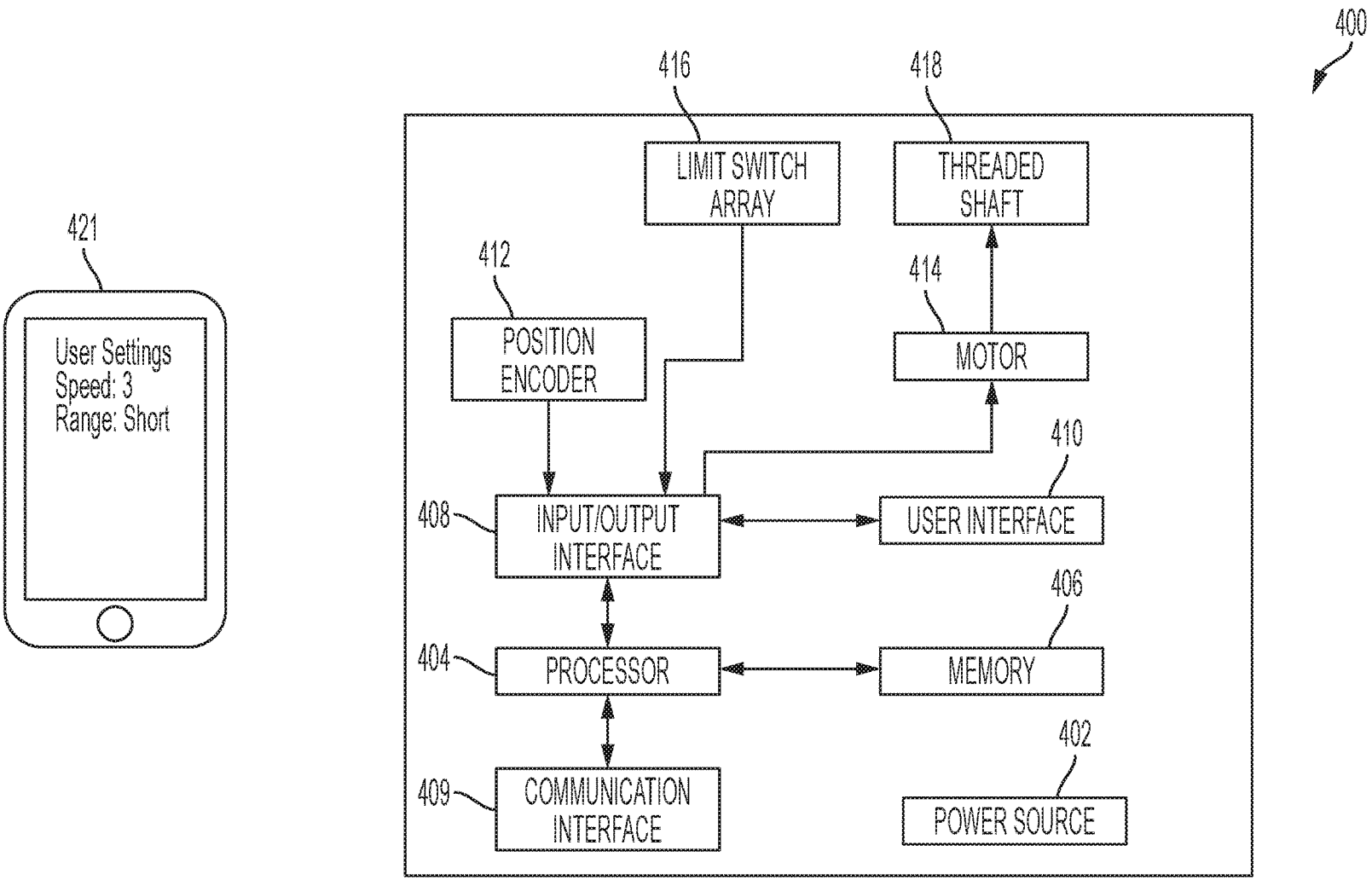
FIG. 12 is a block diagram showing components of an embodiment of the present invention.

FIG. 12 is a block diagram showing components of an embodiment of the present invention. The diagram of FIG. 12 shows a massager device 400 that includes a processor 404 and a memory 406 coupled to the processor 404, an input/output (I/O) interface 408 coupled to the processor 404, and a user interface 410 coupled to the I/O interface 408.

A power source 402 powers the processor 404, motor 414, and other electronic components. Power source 402 may be a battery, which may be a replaceable, or internally sealed rechargeable battery. In some embodiments, the battery may be USB-chargeable, inductively chargeable, or other suitable charging mechanism now known or hereafter developed. It should be recognized that any power source, now known or hereafter developed, may be used. More than one battery may be included in some embodiments. In some embodiments, the stimulation device may be powered by alternating current power, such as 120V or 240V standard household power, with a power adapter comprising voltage regulators to convert the power to an appropriate DC level (e.g. 12V DC).

The memory 406 may include a non-transitory computer readable medium including, but not limited to, flash, EEPROM, static ram (SRAM), or other suitable storage type. The memory 406 contains instructions, that when executed by processor 404, enable embodiments of the present invention. The user interface 410 may comprise one or more buttons, lights, buzzers, liquid crystal displays, and/or other suitable components for control and operation of the massager device.

The massager device may further include a communication interface 409, which may support a wired and/or wireless communication protocol, including, but not limited to, WiFi, Bluetooth, infrared, or other suitable communication protocol. The communication interface 409 can enable communication with a remote device 421 such as a smartphone or tablet computer to enable additional user interface functions on the remote device. In some embodiments, the massager device 400 may be controllable via an application on the remote device 421, instead of, or in addition to user interface 410. Accordingly, in some embodiments, the user interface 410 may not be present.

The massager device further includes motor 414. The direction of movement of motor 414 may be controlled via a signal from input/output interface 408. The motor 414 is mechanically coupled to threaded post 418. A position encoder 412 may be used to allow the processor 404 to track the amount of rotation of the threaded post, and thus, the location of the roller. Optionally, a limit switch array 416 may be utilized to detect an occurrence where the roller travels beyond a specified limit. The processor can be configured to disable the motor 414 under such a condition, for safety purposes. In other embodiments, the current level drawn by the motor is used as a criterion for position detection. In embodiments, the current level has a dramatic increase at the end of travel or if the ball stops. This condition can be used as a signal to stop operation of the device. This is an example condition, and other occurrences or conditions can be monitored and rectified if necessary.

Still referring to FIG. 12, in some embodiments, the memory 406 contains instructions, that when executed by the processor 404, alternate motion direction of the motor such that the spherical roller oscillates between the start range position and the end range position. In some embodiments, the memory contains instructions, that when executed by the processor, establish a second start range position and a second end range position, wherein the second start range position and second end range position define a second range. In some embodiments, the memory contains instructions, that when executed by the processor, establish a range transition time to switch between the first range and the second range.

Figure 13A:
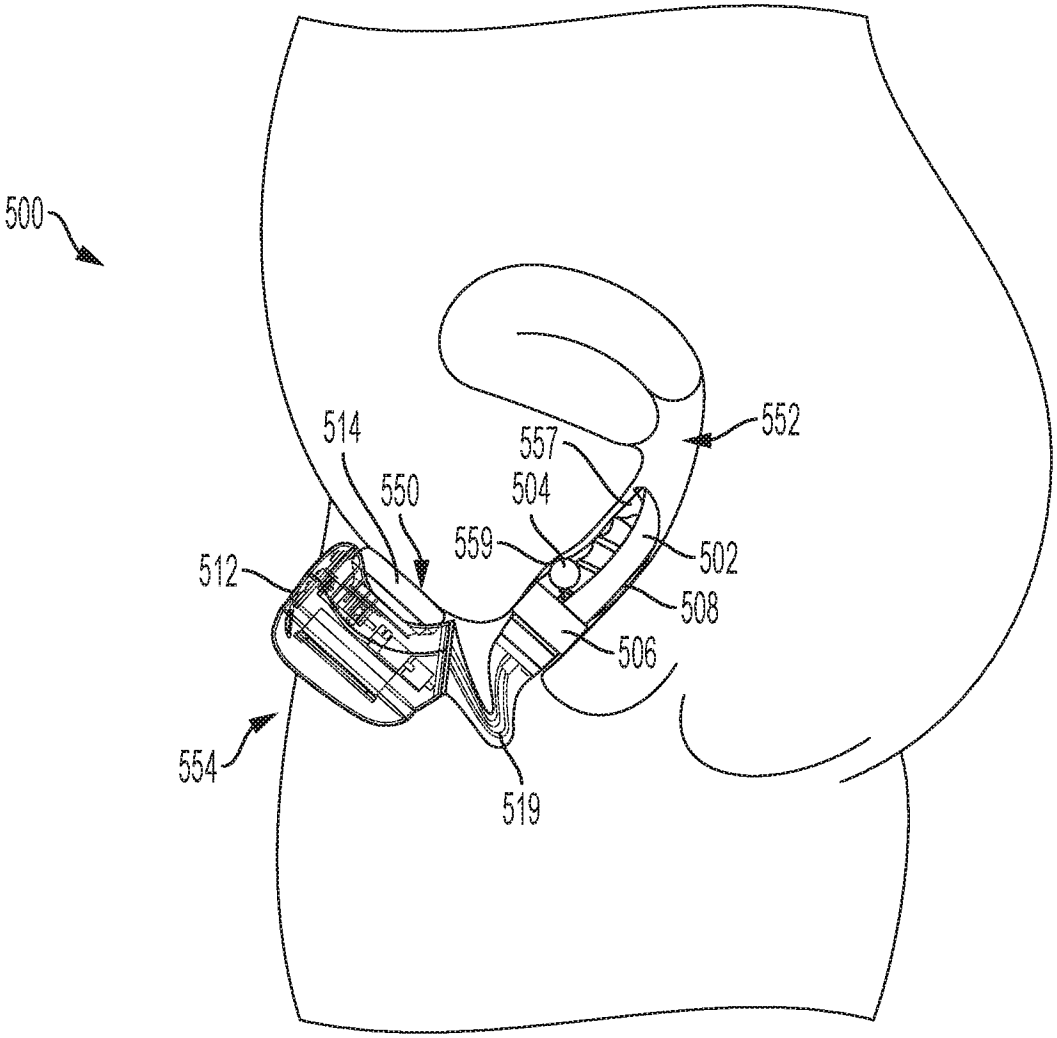
FIG. 13A shows an example usage on a user's body in a deflated configuration.
Figure 13B:
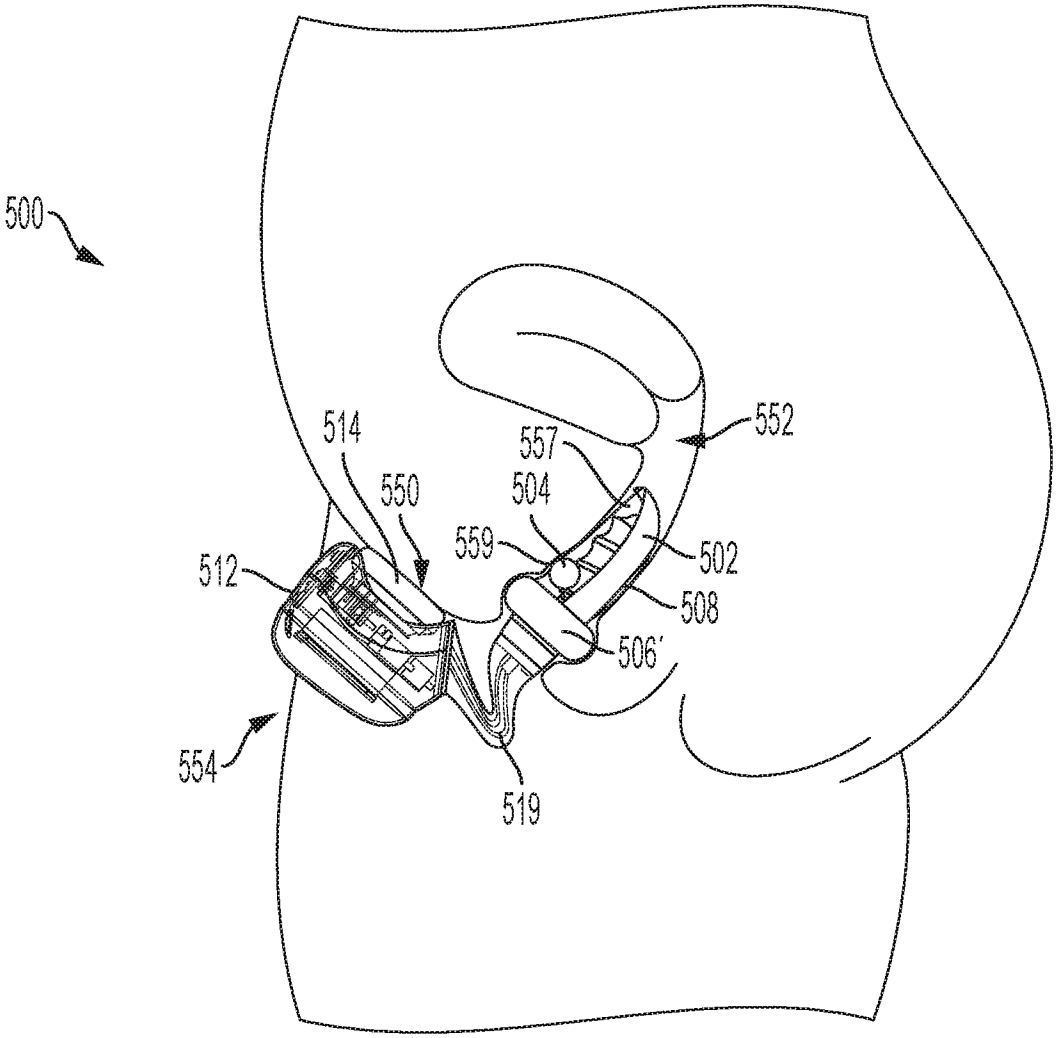
FIG. 13B shows an example usage with the ring chamber inflated and shaft chamber contracted.
Figure 13C:
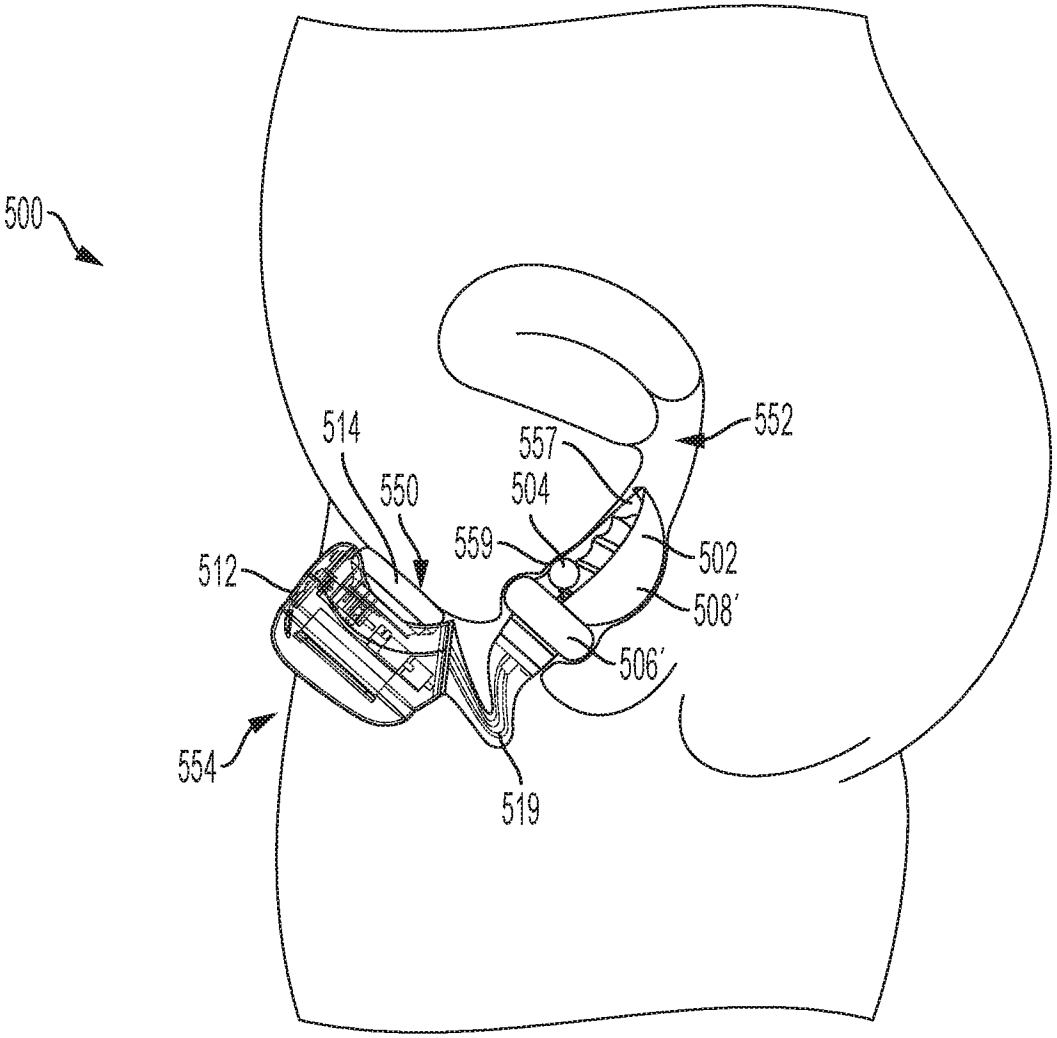
FIG. 13C shows an example usage with both the ring chamber inflated shaft chamber inflated.

FIG. 13A shows an example usage on a user's body (shown in cross-section) in a deflated configuration. User's body 500 is shown as a cross-section. In FIGS. 13A-13C, an exterior sheath and second portion (similar to 212) of the enclosure is removed for clarity. User 500 has a device 554 in accordance with embodiments of the present invention inserted into the vagina 552 in a deflated configuration. The shaft 502 is inserted into the vagina 552 such that the roller 504 of the G-spot stimulator is pressed against the G-spot region 559 (through sheath 557) of the user. The base portion 512 is positioned via arm 519, which in this example, is flexible, to be pressing against the clitoral region 550 of the user. A clitoral stimulator 514 is in contact with the clitoral region 522 of the user. The ring chamber 506 (similar to 106) and shaft chamber 508 (similar to 108) are each in a deflated configuration.

FIG. 13B shows an example usage with the ring chamber 506' inflated and shaft chamber 508 contracted. Embodiments of the device have directional inflation that changes the shape of the shaft. The ring chamber creates a 360 degree of expansion that changes the shape from "bullet" shaped to "bullet with cork". The expansion of the shaft chamber does not extend around the entire circumference of the shaft. The expansion of the ring chamber is over less than the entire length of the shaft. When present, the ring creates a "wedge" in the vaginal canal to further secure the massager device in the vagina, allowing the massager device to be worn hands free. As shown, in this configuration, the device 554 is firmly wedged inside the vagina, allowing improved G-spot stimulation and a hands-free mode of operation.

FIG. 13C shows an example usage with both the ring chamber 506' inflated shaft chamber 508' expanded. The expansion of the shaft chamber 506' puts force on the vaginal walls to push the stimulator closer to the G-spot, and the expansion can allow hand-free operation. As can now be appreciated, disclosed embodiments provide improvements in G-spot massaging devices by enabling a hands-free mode of operation via a plurality of inflatable chambers. In embodiments, the amount of inflation for each chamber is user-controlled, allowing for a customizable fit and maximizing comfort and enjoyment for the user.

Although shown in FIGS. 13A-13B inserted into a vagina, in other usage cases, the shaft 102 can be inserted into a user's rectum via an anus.

Figure 14:
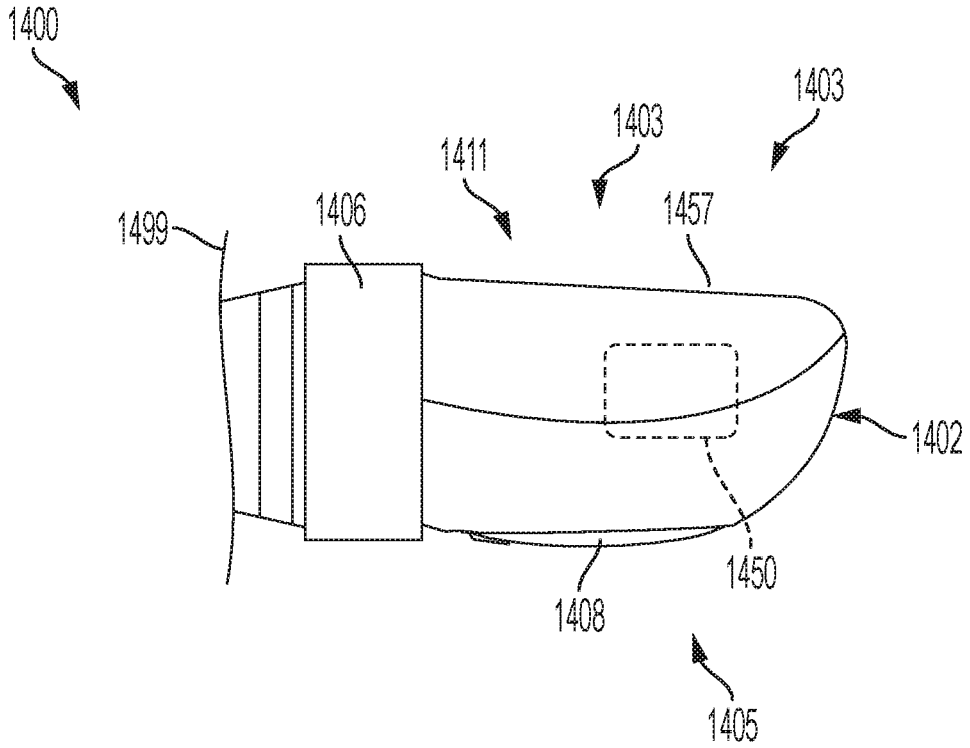
FIG. 14 shows an alternative embodiment of the present invention having an insertable portion including a vibrator.

FIG. 14 shows an alternative embodiment of the present invention having an insertable portion 1400 cut off at break line 1499. A sheath is removed for clarity. Portion 1400 includes a stimulator 1411 (instead of a roller massager), which is a vibrator having a motor 1450 that may be a geared motor mechanism that may have, e.g., an asymmetrical load affixed to a rotating shaft, a linear resonant actuator, or a pancake vibration motor, etc., for causing massage by, for example, a vibration pattern. In some embodiments, the stimulator may be a pulsator, gyrator, oscillator, or other suitable mechanism. Accordingly, the massage action may be vibration, pulsation, gyration, oscillation, rubbing, or another.

A surface 1457, on a first side 1403 of shaft 1402, is configured to be in contact with a G-spot area or prostate area of a user (through a sheath). Surface 1457 may be flat, or have bumps and ridges thereon for additional desirable stimulation. In embodiments, the shaft chamber 1408 is inflatable by the user via a user interface (e.g. similar to user interface 734 of FIG. 7B). Shaft chamber 1408 (similar to chamber 108), on the second side of shaft 1402, pushes the massage surface 1457 of the stimulator 1411 against the G-spot or prostate area of the user, for an enhanced user experience. Additionally, a ring chamber 1406 (similar to chamber 106) may be used to help wedge the stimulator 1411 inside the vagina or rectum of a user, thereby enabling hands-free operation.

Figure 15:
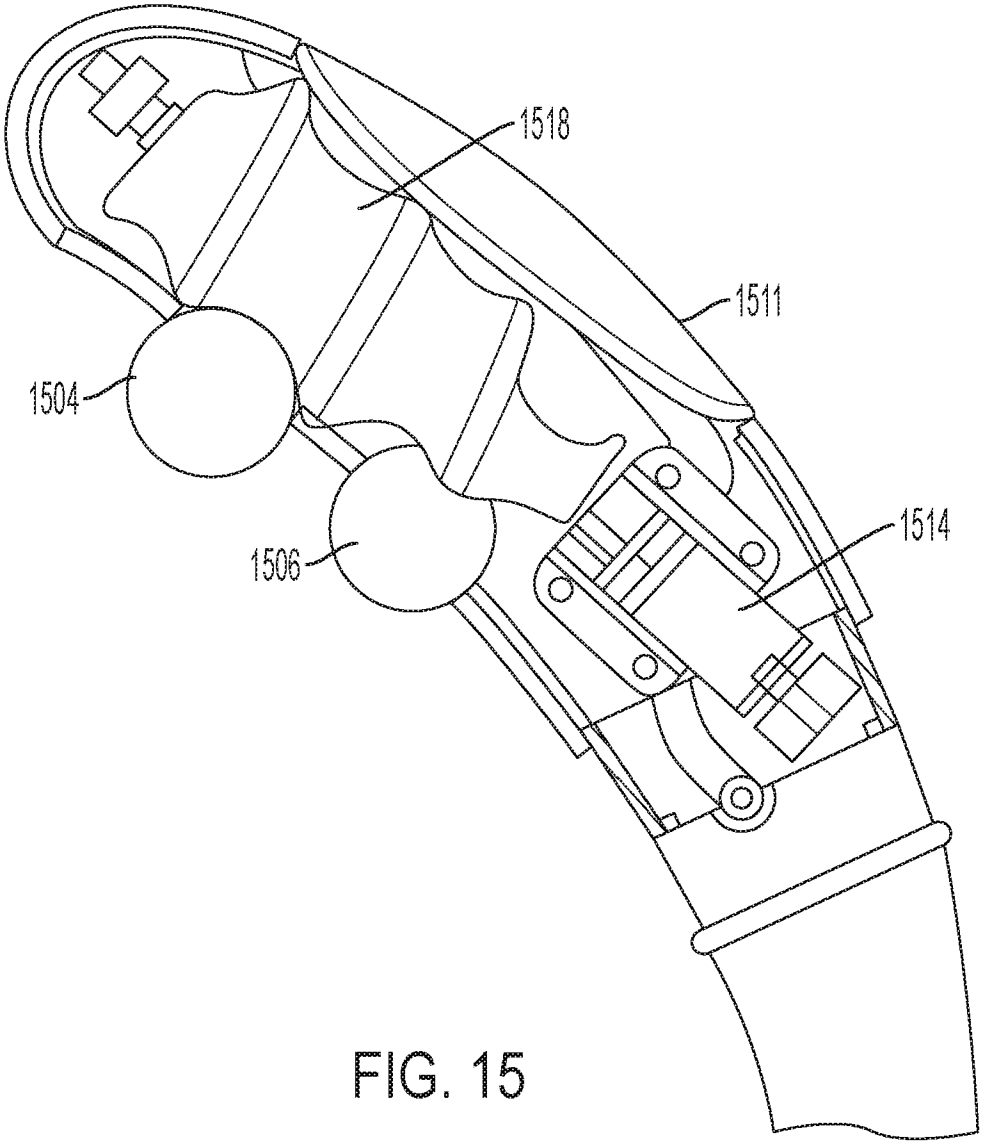
FIG. 15 shows a cutaway view of a portion of an alternative embodiment of the present invention including a plurality of rollers.

FIG. 15 shows a cutaway view of a portion of an alternative embodiment of the present invention including a plurality of rollers, with the external sheath removed for clarity. In this embodiment, a first roller 1504 and a second roller 1506 are included within enclosure 1511. As the motor 1514 turns the threaded post 1518, both rollers 1504 and 1506 are moved back and forth, creating a unique sensation in the G-spot area of a user. Thus, in some embodiments, a plurality of rollers are included. As shown, there are two rollers on a single threaded post 1518 in the example. In some embodiments, there may be more than two rollers included. In some embodiments, the first roller 1504 and second roller 1506 may be of the same size and/or shape. In other embodiments, the first roller 1504 may be of a different size and/or shape than the second roller 1506.

Figure 16:
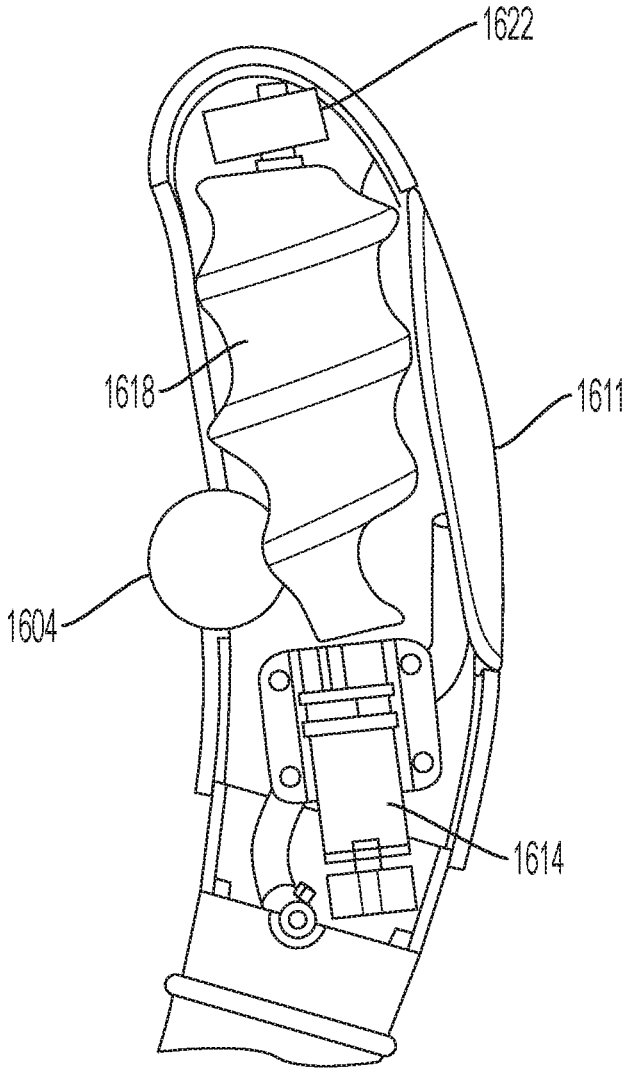
FIG. 16 shows a cutaway view of an embodiment including a vibrator in addition to a roller massager.

FIG. 16 shows a cutaway view of an embodiment, wherein a vibrator 1622 (such as a pancake motor) in included within the shaft/enclosure along with the roller massager. Vibration stimulation can be imparted as well as massage of the roller. In embodiments, the enclosure 1611 includes a first motor 1614 which is coupled to threaded post 1618. Roller 1604 is disposed on threaded post 1618. As the first motor 1614 rotates the threaded post 1618, the roller moves along the threaded post 1618, creating a massaging sensation for the user. A second motor 1622 may be included within enclosure 1611 for imparting vibration to the enclosure 1611. The vibration can provide an additional pleasurable sensation for the user. In embodiments, the second motor may be a pancake motor. In embodiments, the second motor may be disposed at a distal end of the threaded post 1618, opposite the first motor 1614. In embodiments, the second motor 1622 may be configured to operate independently of the first motor 1614, such that the user can enable or disable the vibration independently of the operation of the roller 1604.

Figure 17:
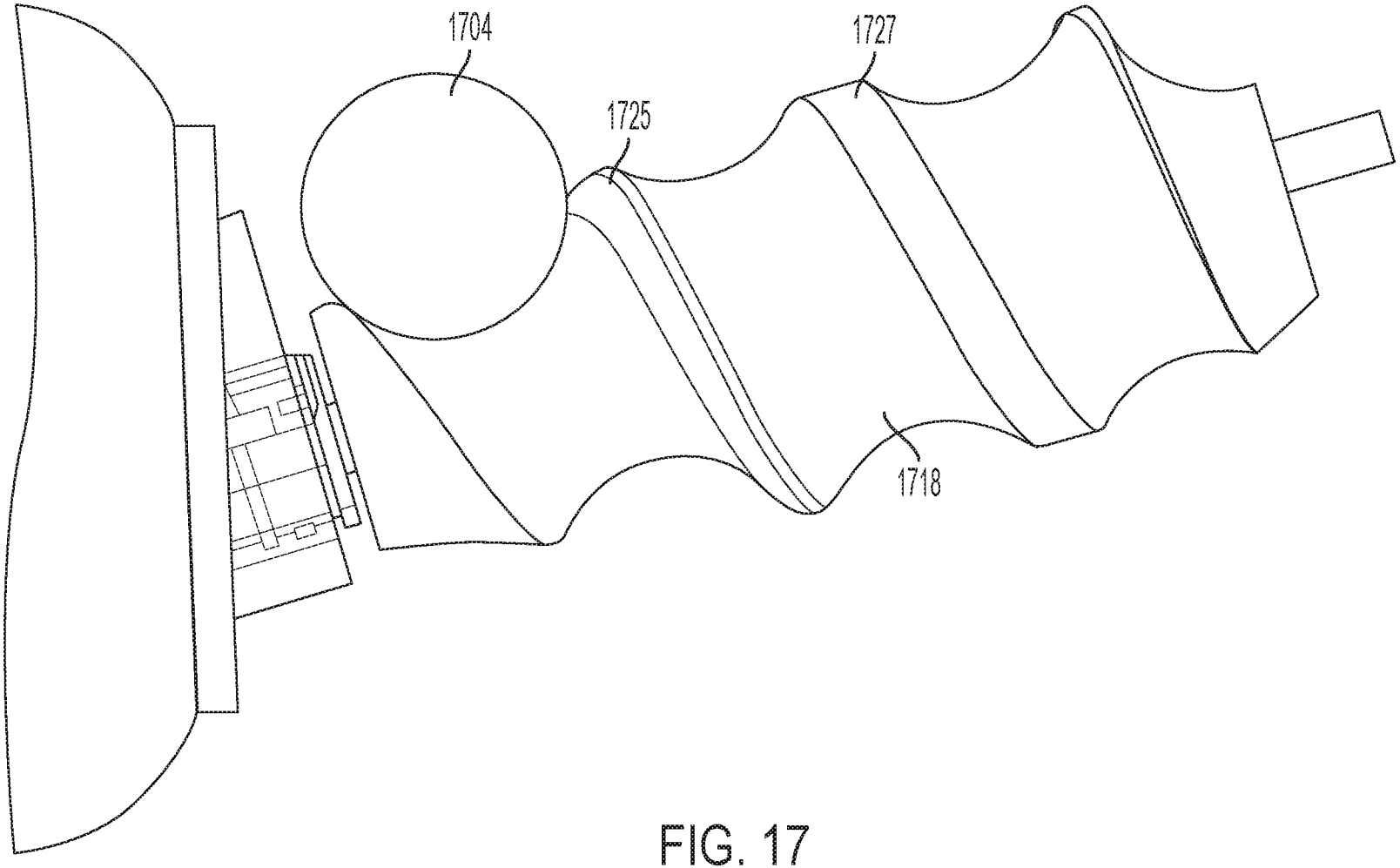
FIG. 17 shows an embodiment where threaded post has one or more flattened portions.

FIG. 17 shows an embodiment where threaded post 1718 has one or more flattened portions 1727 of the threads such that the friction of the elastic sheath (e.g. 157 of FIG. 1A) causes the roller 1704 to travel over those portions rather than smoothly follow the threads of the threaded post 1718. This creates a "bump" sensation that can be pleasurable to a user. The threaded post 1718 may also include some non-flattened portion(s) 1725 of threads. Accordingly, in some embodiments the threads of the threaded post are of an irregular shape. In some embodiments, the threaded post 1718 includes one or more flattened portions of threads. In some embodiments, the threaded post 1718 may include a combination of flattened and non-flattened portions of threads.

Figure 18B:
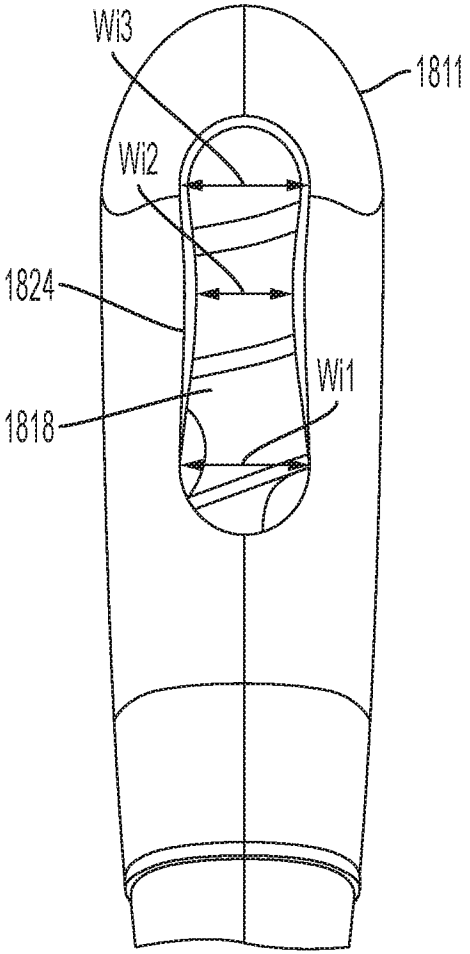
FIG. 18B shows a diagram of how portions of the opening of the enclosure may be narrower in some areas than in others to achieve a desired plane of the roller protruding therefrom.
Figure 18A:
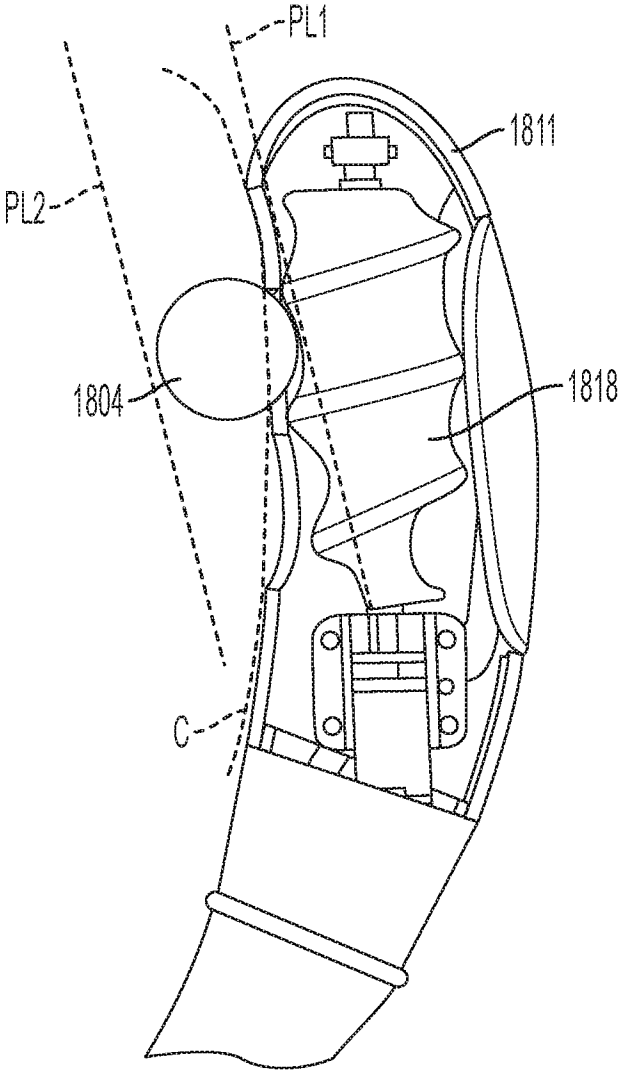
FIG. 18A shows a diagram of planes of the second stimulator of some embodiments of the present invention.

FIG. 18A and FIG. 18B show diagrams of how portions of the opening of the enclosure may be narrower in some areas than in others to achieve a desired plane of the roller protruding therefrom. Referring now to FIG. 18A, showing a side cutaway view of a shaft portion. The threaded post 1818 is disposed such that it has a plane PL1 parallel to its longitudinal axis. The enclosure 1811 is formed with a curvature C such that the protrusion of the roller 1804 is such that the travel of the roller 1804 is along a plane PL2, where plane PL2 is parallel to plate PL1. FIG. 18B shows the opening 1624 having a varying width. As shown in FIG. 18B, there is a first width W1, a second width W2, and third width W3. In some embodiments, width W2 is less than width W1, and width W2 is less than width W3. The width of the opening 1824 controls the amount of protrusion of the roller 1804. The width of the opening 1824 can be selected to control the amount of protrusion, and thus, affect the travel path of roller 1604.

Figure 19:
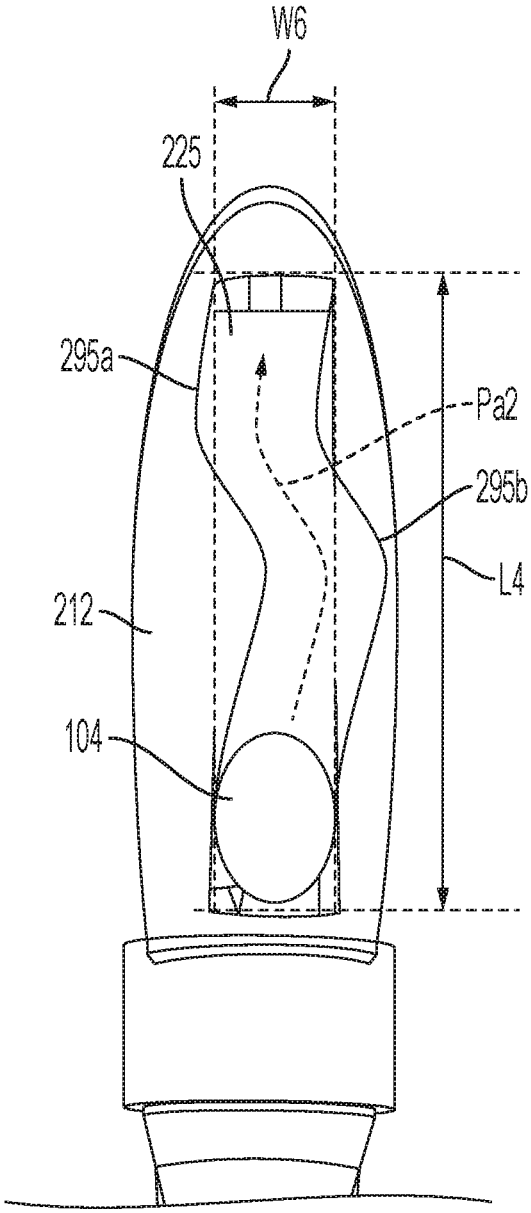
FIG. 19 is a front view of a portion of a massager device in accordance with alternative embodiments of the present invention showing detail of the enclosure portion without a sheath thereon.

FIG. 19 is a front view of a portion of a massager device in accordance with alternative embodiments of the present invention showing detail of the enclosure portion 212 without a sheath thereon. The embodiment of FIG. 19 comprises an opening 225 which comprises non-linear rails 295*a* and 295*b*. The non-linear rails cause the roller 104 to move along path Pa2 when the threaded post rotates. Thus, in embodiments, the massager device is configured such that the travel path of the roller is non-linear. In some embodiments, as shown in FIG. 19, the path Pa2 of roller 104 is an S-curve. Thus, in embodiments, the roller travels in an S-curve path between the start range position and the end range position. Other non-linear paths are possible with embodiments of the present invention. The non-linear path of the roller 104 can create a pleasurable sensation in some users, as compared with a linear path as depicted in FIG. 11C. W6 and L4 may have similar dimensions as in FIG. 11C.

Figure 20A:
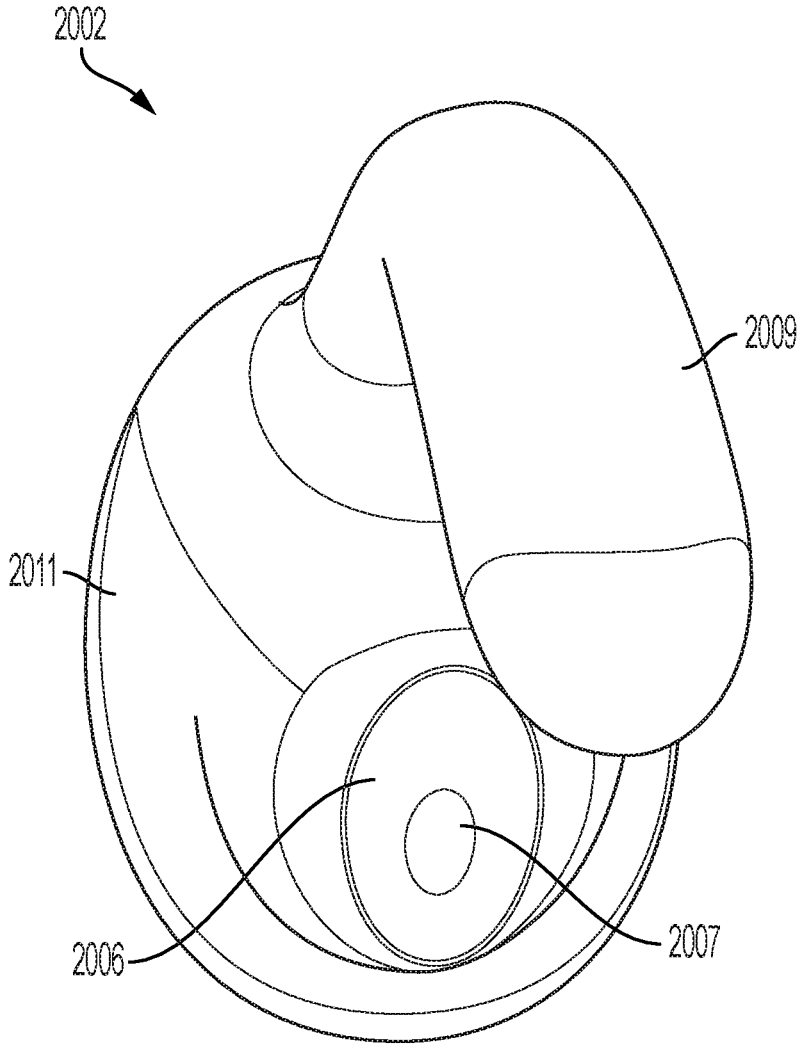
FIG. 20A shows a top-down view of an example sheath.
Figure 21:
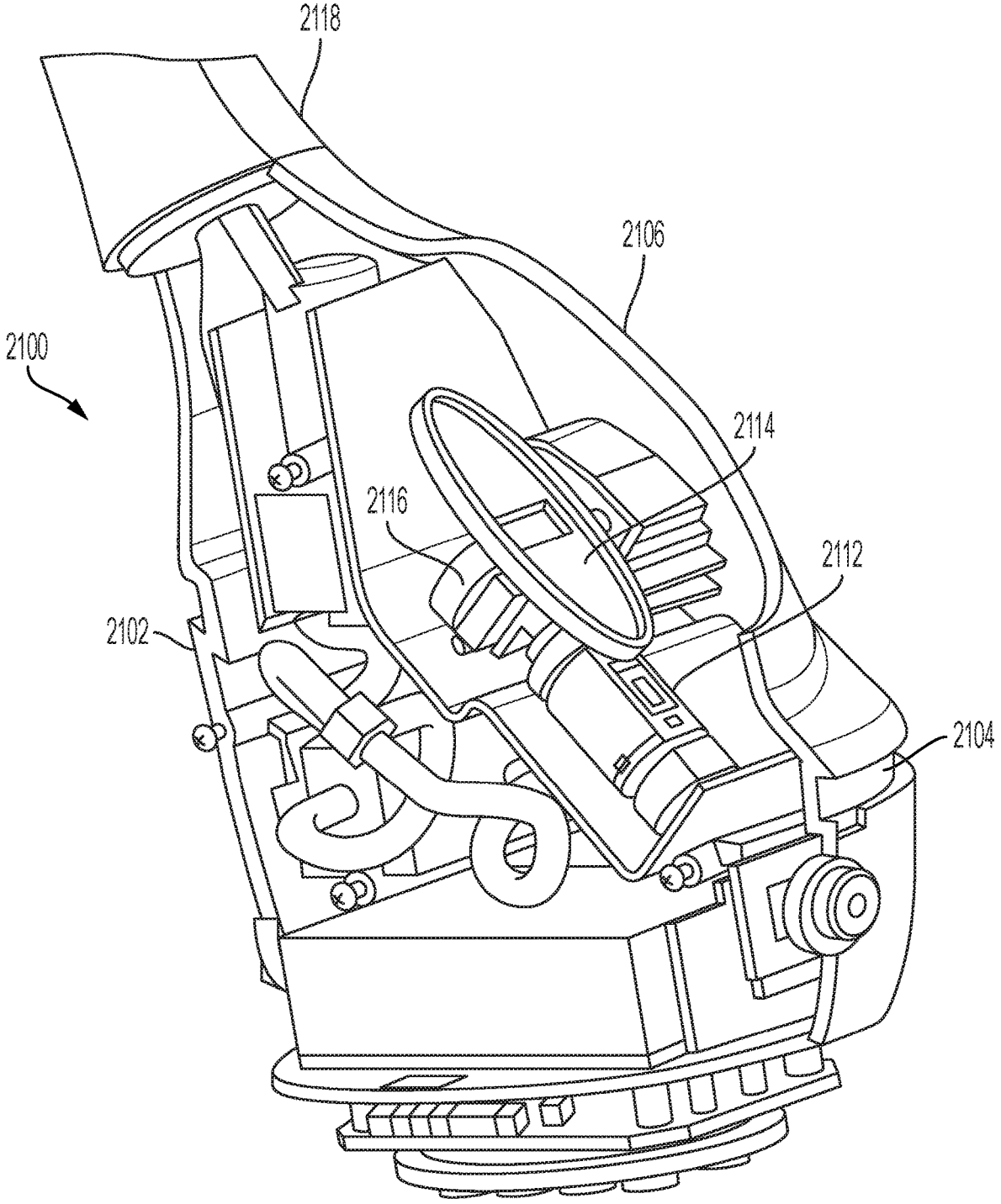
FIG. 21 shows a partial cutaway view of the internal components of a base including a pressure field stimulator in accordance with some embodiments of the invention.

FIG. 20A shows a top-down view of an example sheath 2002. In embodiments, the sheath 2002 is disposed over the shaft and a second stimulator, such as a pressure field stimulator 2100 (FIG. 21). The sheath 2002 is flexible, resilient, and elastic, and stretches over and attaches to the housing 2102 (FIG. 21) of the pressure field stimulator of embodiments with a tight fit. The example shown includes shaft portion 1609 that stretches over a shaft. In some embodiments, the sheath 2002 is made of silicone, rubber, TPE, plastic or other flexible and elastic material. The cup 2006 has cavity 2007. In some embodiments, the cup is molded into the sheath, such that the cup and sheath consist together of a single piece of material. In such embodiments, the cup and sheath may be injection molded via a single mold such that the resulting cup-sheath is a single piece and not made of two pieces. Injection molding is an example, and any suitable method of making is included within the scope of the invention.

Figure 20B:
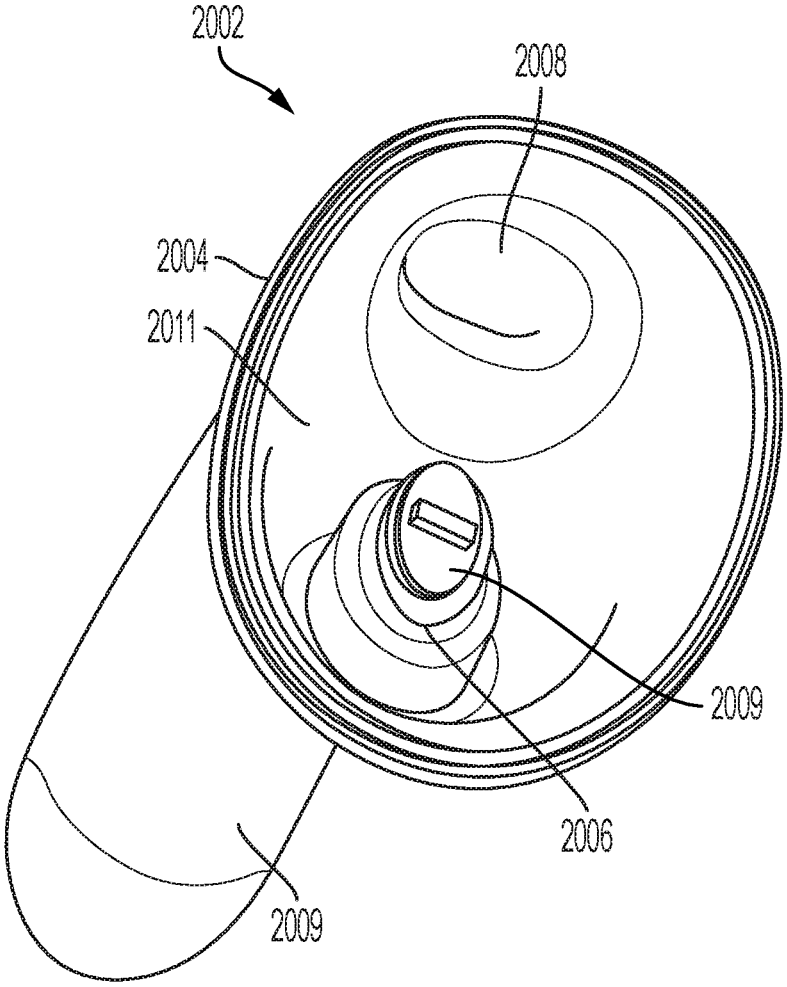
FIG. 20B shows a bottom-up view of the sheath of FIG. 20A.

FIG. 20B shows a bottom-up view of sheath 2002, illustrating the interior of the sheath. During assembly of disclosed embodiments, an interior shaft opening 2008 is configured and disposed to receive a shaft and/or arm. An attachment point 2004 is formed around the base portion 2011. In embodiments, attachment point 2004 comprises a raised lip (protrusion) of material.

FIG. 21 shows a partial cutaway view of the internal components of a base, extending from arm 2118, including a pressure field stimulator 2100 in accordance with some embodiments of the invention. The sheath 2002 is attached to the pressure field stimulator 2100 in any suitable way. In some embodiments, it may be via reciprocal grooves and protrusions on the housing and sheath noted as attachment point 2006 on the sheath 2002 and attachment point 2104 on the housing. The sheath 2002 may be adhered, instead or in addition, to the reciprocal grooves and protrusions. A portion of the housing 2102 and groove 2104 where the sheath 2002 attaches is in view. The pressure field stimulator 2100 includes a housing 2102 that houses internal components, including, but not limited to, motor(s), pump(s), batteries, circuits, and/or other components. A groove 2104 is formed within the housing 2102 that is configured and disposed to receive attachment point 2004 (FIG. 20B) of the sheath 2002. The housing 2102 may further include at least one support flange 2106, which provides mechanical support for the base portion 2111 (pressure field stimulator housing) and/or cup 2006 of the sheath 2002. In some embodiments, the width of the groove 2104 and the width of protrusion 2004 are sized such that a tight friction fit forms between them when the attachment pint 2004 is applied to groove 2104. In some embodiments, the sheath 2002 may be removable by the user to facilitate cleaning. In other embodiments, the sheath 2002 may be permanently affixed to the housing 2102 via adhesive, sealant, or other suitable technique.

Pressure field stimulator can be in any suitable configuration. As shown, the example pressure field stimulator can include, in addition to the cup, a driver comprising a motor 2112, cam 2116, and plate 2114. The plate is disposed on an underside of the cup (FIG. 20B); the cam disposed adjacent to the plate; and the motor is mechanically coupled to the cam. The driver is configured to intermittently vary a volume of the cavity (2007 of FIG. 20) of the cup from a first volume to a second volume without returning the cup from the second volume to the first volume. In some embodiments, the cup returns from the second volume to the first volume, in between intermittent varying from the first volume to the second volume, due to the resilient nature of the material of the cup and/or the configuration of the cup. In some embodiments, returning from the second volume to the first volume is achieved without a force external to the cup structure, such as electrical assistance or mechanical assistance from another article or device. This varying of the volume between the first and second volumes creates a pressure field in a chamber formed by the cavity and a user's skin.

An example pressure field stimulator is described in U.S. patent application Ser. No. 16/569,697 filed on Sep. 13, 2019. The contents of such application are incorporated herein by reference to the extent not inconsistent with this disclosure. Note that the example pressure field stimulators shown and described there are examples, and not meant to be limiting of the present invention/application.

It should also be recognized that the second stimulator is not limited to a pressure field stimulator. The second stimulator could instead be a vibrator, oscillator, gyrator, pulsator, another roller massager, or other suitable mechanism.

Some embodiments are waterproof such that they may be washed with fluids, like soap and water. Accordingly, the sheath and any other external portions are sealed. This allows a user to clean the device thoroughly between insertions.

In some embodiments, the massager device is unitary in structure, meaning the components thereof together form a single product, rather than multiple products which may be used together by a user.

It should be recognized that although described as applicable to massage of a G-spot, prostate, or clitoris, that embodiments may be used for stimulation of any suitable body part.

While the invention has been particularly shown and described in conjunction with exemplary embodiments, it will be appreciated that variations and modifications will occur to those skilled in the art. The embodiments according to the present invention may be implemented in association with the formation and/or processing of structures illustrated and described herein as well as in association with other structures not illustrated. Moreover, in particular regard to the various functions performed by the above described components (assemblies, devices, circuits, etc.), the terms used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application. Therefore, it is to be understood that the appended claims are intended to cover all such modifications and changes that fall within the true spirit of the invention.

What is claimed is:

1. A massager device comprising:

an insertable shaft having a first side and a second side, wherein the first side comprises a massage surface, and wherein the massage surface is not inflatable;

a stimulator;

an expandable shaft chamber disposed on the second side of the insertable shaft; and a dual-port input valve.

2. The massager device of claim 1, wherein the stimulator is a vibrator, gyrator, oscillator, or pulsator.

3. The massager device of claim 1, wherein the stimulator comprises an object configured to roll adjacent to an underside of a massage surface.

4. The massager device of claim 3, wherein the stimulator comprises:

an enclosure comprising an opening, wherein the enclosure is an elongate shape;

a threaded post disposed within the enclosure, the threaded post comprising a plurality of pitched threads;

a spherical object disposed within the plurality of pitched threads, wherein the spherical object protrudes outside the opening of the enclosure;

a driver configured to rotate the threaded post; and an elastic sheath disposed at least over the opening.

5. The massager device of claim 4, wherein the enclosure is formed with a curvature such that travel of the spherical object is along a plane parallel to a longitudinal axis of the threaded post.

6. The massager device of claim 5, wherein the threaded post comprises one or more flattened portions of threads, and one or more non-flattened portions of threads.

7. The massager device of claim 3, wherein the massage surface is an exterior portion of a sheath disposed over at least a portion of the massager device.

8. The massager device of claim 1, wherein the second side is disposed opposite the first side.

9. The massager device of claim 1, wherein the expandable shaft chamber does not inflate the first side of the insertable shaft; and wherein the expandable shaft chamber does not extend around an entire circumference of the shaft.

10. The massager device of claim 1, wherein the expandable shaft chamber is an inflatable pneumatic chamber.

11. The massager device of claim 1, further comprising a pump.

12. The massager device of claim 1, further comprising an exhaust valve.

13. A massager device comprising:

an insertable shaft having a first side and a second side, wherein the first side comprises a massage surface;

a stimulator;

an expandable shaft chamber disposed on the second side of the insertable shaft; and a flexible arm, wherein the insertable shaft is affixed to a first end of the flexible arm.

14. The massager device of claim 13, wherein a pneumatic conduit is disposed within the flexible arm between an expandable shaft chamber and a base affixed to a second end of the arm.

15. The massager of claim 1, further comprising:

a processor; and a memory coupled to the processor, wherein the memory contains instructions, that when executed by the processor, control a configuration of the dual-port input valve.

16. The massager device of claim 15, wherein the memory further comprises instructions, that when executed by the processor, inflate the ring chamber and inflate the shaft chamber.

17. The massager device of claim 15, further comprising a ring chamber pressure sensor, and wherein the memory contains instructions, that when executed by the processor, stop a pump in response to detecting a ring chamber pressure limit.

18. The massager device of claim 15, further comprising a shaft chamber pressure sensor, and wherein the memory contains instructions, that when executed by the processor, stop a pump in response to detecting a shaft chamber pressure limit.

19. A massager device comprising:

an insertable shaft having a first side and a second side, wherein the first side comprises a massage surface;

a stimulator;

an expandable shaft chamber disposed on the second side of the insertable shaft:

an input valve configured to supply air to the expandable shaft chamber;

a processor; and a memory coupled to the processor, wherein the memory contains instructions, that when executed by the processor, control a configuration of the input valve.

20. The massager device of claim 19, wherein the memory further comprises instructions, that when executed by the processor, inflate the shaft chamber.

21. The massager device of claim 19, further comprising a ring chamber pressure sensor, and wherein the memory contains instructions, that when executed by the processor, stop a pump in response to detecting a ring chamber pressure limit.

22. The massager device of claim 19, further comprising a shaft chamber pressure sensor, and wherein the memory contains instructions, that when executed by the processor, stop a pump in response to detecting a shaft chamber pressure limit.

23. The massager device of claim 1, further comprising a handle.

* * * * *